US011776480B2

(12) United States Patent
Jeong et al.

(10) Patent No.: US 11,776,480 B2
(45) Date of Patent: Oct. 3, 2023

(54) PIXEL AND DISPLAY DEVICE INCLUDING THE SAME

(71) Applicant: Samsung Display Co., Ltd., Yongin-si (KR)

(72) Inventors: Min Jae Jeong, Yongin-si (KR); Jang Mi Kang, Yongin-si (KR); Hyeong Seok Kim, Yongin-si (KR); Jun Hyun Park, Yongin-si (KR); Mu Kyung Jeon, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 17/860,676

(22) Filed: Jul. 8, 2022

(65) Prior Publication Data

US 2023/0140604 A1 May 4, 2023

(30) Foreign Application Priority Data

Nov. 3, 2021 (KR) ..... 10-2021-0150090

(51) Int. Cl.
*G09G 3/3258* (2016.01)
*G09G 3/3266* (2016.01)
(Continued)

(52) U.S. Cl.
CPC ..... *G09G 3/3258* (2013.01); *G09G 3/3266* (2013.01); *G09G 3/3233* (2013.01);
(Continued)

(58) Field of Classification Search
CPC .. G09G 3/3258; G09G 3/3266; G09G 3/3233; G09G 3/3291; G09G 2300/0819;
(Continued)

(56) References Cited

U.S. PATENT DOCUMENTS 7,414,599 B2 8/2008 Chung et al.
8,614,657 B2 * 12/2013 Han ..... G09G 3/3233 345/77
(Continued)

FOREIGN PATENT DOCUMENTS

CN 112634832 4/2021
KR 10-0560780 3/2006
(Continued)

OTHER PUBLICATIONS

Notice of Allowance dated Mar. 21, 2023, issued to U.S. Pat. No. 173816,489.

*Primary Examiner* — Tom V Sheng
(74) *Attorney, Agent, or Firm* — H.C. Park & Associates, PLC

(57) ABSTRACT

A pixel includes a light emitting element, a first transistor connected between first and second nodes and that generates a driving current flowing from a first power line to a second power line through the light emitting element, a second transistor connected between a data line and the first node and turned on in response to a fourth scan signal, a third transistor connected between the second node and a third node corresponding to a gate electrode of the first transistor and turned on in response to a second scan signal, a fourth transistor connected between the third node and a third power line providing a third power voltage and turned on in response to a first scan signal, and a fifth transistor connected between the first and fourth nodes and turned on in response to a fifth scan signal.

20 Claims, 14 Drawing Sheets

(51) Int. Cl.
*G09G 3/3291* (2016.01)
*G09G 3/3233* (2016.01)

(52) U.S. Cl.
CPC ... *G09G 3/3291* (2013.01); *G09G 2300/0819* (2013.01); *G09G 2300/0842* (2013.01); *G09G 2300/0861* (2013.01); *G09G 2310/0251* (2013.01); *G09G 2310/0262* (2013.01); *G09G 2310/08* (2013.01); *G09G 2320/0233* (2013.01); *G09G 2320/0238* (2013.01); *G09G 2320/0247* (2013.01); *G09G 2320/0257* (2013.01); *G09G 2320/043* (2013.01); *G09G 2320/045* (2013.01); *G09G 2330/02* (2013.01)

(58) Field of Classification Search
CPC ... G09G 2300/0842; G09G 2300/0861; G09G 2310/08; G09G 2310/0251; G09G 2310/0262; G09G 2320/0238; G09G 2320/0247; G09G 2320/0257; G09G 2320/045; G09G 2320/0233; G09G 2320/043; G09G 2330/02
USPC ..... 345/211
See application file for complete search history.

(56) References Cited

U.S. PATENT DOCUMENTS 9,093,008 B2 * 7/2015 Kato ..... G09G 3/003
11,056,049 B2 7/2021 Kim et al.
11,270,640 B2 3/2022 Kim et al.
2003/0227262 A1 * 12/2003 Kwon ..... G09G 3/325 315/169.3
2005/0287750 A1 * 12/2005 Lee ..... G09G 3/3233 438/69
2006/0028408 A1 * 2/2006 Kim ..... G09G 3/3233 345/76
2008/0048955 A1 * 2/2008 Yumoto ..... G09G 3/3233 345/82
2008/0170010 A1 * 7/2008 Kim ..... G09G 3/3233 345/76
2008/0309653 A1 * 12/2008 Takahashi ..... G09G 3/3233 345/211
2009/0167743 A1 * 7/2009 Goh ..... G09G 3/3233 345/76
2010/0073344 A1 * 3/2010 Ohhashi ..... H01L 21/6719 345/76
2011/0141095 A1 * 6/2011 Matsui ..... G09G 3/3233 345/76
2012/0019498 A1 * 1/2012 Jeong ..... G09G 3/3233 345/76
2012/0119667 A1 * 5/2012 Kitazawa ..... G09G 3/3291 315/320
2013/0038588 A1 * 2/2013 Ono ..... G09G 3/2092 345/211
2013/0187554 A1 * 7/2013 Ono ..... G09G 3/3233 315/172
2014/0307012 A1 * 10/2014 Kishi ..... G09G 3/3241 345/691
2015/0279277 A1 * 10/2015 Xu ..... G09G 3/3233 345/77
2015/0371606 A1 12/2015 Lee
2016/0055792 A1 2/2016 Lee et al.
2016/0063943 A1 * 3/2016 Lee ..... G09G 3/3233 345/82
2017/0084220 A1 * 3/2017 Im ..... G09G 3/3233
2017/0186378 A1 * 6/2017 Na ..... G09G 3/3266
2019/0164491 A1 * 5/2019 Kim ..... H10K 59/131
2019/0180687 A1 * 6/2019 Gai ..... G09G 3/3258
2021/0049965 A1 * 2/2021 Jeon ..... G09G 3/3233
2021/0125543 A1 4/2021 Kim et al.
2021/0142733 A1 5/2021 Kim et al.
2021/0327352 A1 10/2021 Zhang et al.
2021/0407419 A1 12/2021 Li et al.
2022/0230592 A1 * 7/2022 Zhao ..... G09G 3/3258
2022/0398978 A1 * 12/2022 Kim ..... G09G 3/3241

FOREIGN PATENT DOCUMENTS

KR 10-20190069208 6/2019
KR 10-20210013509 2/2021
KR 10-20210019635 2/2021
KR 10-20210050050 5/2021
KR 10-20210057277 5/2021

* cited by examiner

PIXEL AND DISPLAY DEVICE INCLUDING THE SAME

CROSS REFERENCE TO RELATED APPLICATION

This application claims priority from and the benefit of Korean Patent Application No. 10-2021-0150090, filed on Nov. 3, 2021, which is hereby incorporated by reference for all purposes as if fully set forth herein.

BACKGROUND

Field

Embodiments of the invention relate generally to a pixel and a display device including the same.

Discussion of the Background

A display device includes a plurality of pixels. Each of the pixels includes a plurality of transistors, and a light emitting element and a capacitor electrically connected to the transistors. The transistors generate a driving current based on signals provided through signal lines, and the light emitting element emits light based on the driving current.

A display device of low power consumption is required to improve driving efficiency according to a driving condition of the display device. For example, power consumption of the display device may be reduced by decreasing a frame frequency (or a driving frequency) when displaying a still image. In addition, the display device may display an image at a high frame frequency of 120 Hz or higher to implement high resolution, a stereoscopic image, or the like.

As described above, in order to display an image in various conditions, the display device may display the image at various frame frequencies (or driving frequencies).

The above information disclosed in this Background section is only for understanding of the background of the inventive concepts, and, therefore, it may contain information that does not constitute prior art.

SUMMARY

Inventive concepts consistent with one or more embodiments provide for a pixel in which a compensation period is sufficiently secured and display quality deterioration according to a hysteresis characteristic change of a driving transistor is prevented (or removed).

Inventive concepts consistent with one or more embodiments provide for a display device that includes a pixel having such features as described in the above paragraph.

Additional features of the inventive concepts will be set forth in the description that follows, and in part will be apparent from the description, or may be learned by practice of the inventive concepts.

According to one embodiment, a pixel may include a light emitting element, a first transistor connected between a first node and a second node and that generates a driving current flowing from a first power line that provides a first power voltage to a second power line that provides a second power voltage through the light emitting element, a second transistor connected between a data line and the first node and turned on in response to a fourth scan signal supplied to a fourth scan line, a third transistor connected between the second node and a third node that corresponds to a gate electrode of the first transistor and turned on in response to a second scan signal supplied to a second scan line, a fourth transistor connected between the third node and a third power line that provides a third power voltage and turned on in response to a first scan signal supplied to a first scan line, a fifth transistor connected between the first node and a fourth node and turned on in response to a fifth scan signal supplied to a fifth scan line, a sixth transistor connected between the first power line and the first node and turned off in response to a first emission control signal supplied to a first emission control line, a seventh transistor connected between the second node and a fifth node that corresponds to a first electrode of the light emitting element and turned off in response to a second emission control signal supplied to a second emission control line, a first capacitor connected between the third node and the fourth node, and a second capacitor connected between the first power line and the fourth node.

In an embodiment, the pixel may further include an eighth transistor connected between the fifth node and a fourth power line that provides a fourth power voltage and turned on in response to a third scan signal supplied to a third scan line, and a ninth transistor connected between the first node and a fifth power line that provides a fifth power voltage and turned on in response to the third scan signal.

In an embodiment, the fifth transistor may be an n-type oxide semiconductor transistor.

In an embodiment, the fifth transistor may be a p-type polysilicon semiconductor transistor.

In an embodiment, the pixel may further include a tenth transistor connected between the third node and the fourth transistor and turned on in response to the fifth scan signal.

In an embodiment, the fifth transistor and the tenth transistor may be n-type oxide semiconductor transistors.

In an embodiment, a period in which the third transistor is turned on may overlap at least a portion of a period in which the fifth transistor is turned on.

In an embodiment, a period in which the fourth transistor is turned on may overlap at least a portion of a period in which the fifth transistor is turned on.

In an embodiment, the second scan signal may be a signal from which the first scan signal is shifted.

In an embodiment, the third scan signal may be a signal from which the first scan signal is shifted.

According to another embodiment, a display device may include a pixel connected to first to fifth scan lines, first and second emission control lines, and a data line, a scan driver configured to supply first to fifth scan signals to the first to fifth scan lines, respectively, an emission driver configured to supply first and second emission control signals to the first and second emission control lines, respectively, and a data driver configured to supply a data signal to the data line. The pixel may include a light emitting element, a first transistor connected between a first node and a second node and that generates a driving current flowing from a first power line that provides a first power voltage to a second power line providing a second power voltage through the light emitting element, a second transistor connected between the data line and the first node and turned on in response to the fourth scan signal, a third transistor connected between the second node and a third node that corresponds to a gate electrode of the first transistor and turned on in response to the second scan signal, a fourth transistor connected between the third node and a third power line that provides a third power voltage and turned on in response to the first scan signal, a fifth transistor connected between the first node and a fourth node and turned on in response to the fifth scan signal, a sixth transistor connected between the first power line and the first node and turned off in response to a first emission control signal, a seventh transistor connected between the second node and a fifth node that corresponds to a first electrode of the light emitting element and turned off in response to the second emission control signal, a first capacitor connected between the third node and the fourth node, and a second capacitor connected between the first power line and the fourth node.

In an embodiment, the pixel may further include an eighth transistor connected between the fifth node and a fourth power line that provides a fourth power voltage and turned on in response to the third scan signal, and a ninth transistor connected between the first node and a fifth power line that provides a fifth power voltage and turned on in response to the third scan signal.

In an embodiment, the fifth transistor may be an n-type oxide semiconductor transistor.

In an embodiment, the fifth transistor may be a p-type polysilicon semiconductor transistor.

In an embodiment, the pixel may further include a tenth transistor connected between the third node and the fourth transistor and turned on in response to the fifth scan signal.

In an embodiment, the fifth transistor and the tenth transistor may be n-type oxide semiconductor transistors.

In an embodiment, a period in which the scan driver is configured to supply the first scan signal may overlap at least a portion of a period in which the scan driver is configured to supply the fifth scan signal.

In an embodiment, a period in which the scan driver is configured to supply the second scan signal may overlap at least a portion of a period in which the scan driver is configured to supply the fifth scan signal.

In an embodiment, the scan driver may include a first scan driver configured to supply the first to third scan signals to the first to third scan lines, respectively, a second scan driver configured to supply the fourth scan signal to the fourth scan line, and a third scan driver configured to supply the fifth scan signal to the fifth scan line.

In an embodiment, the second scan signal may be a signal from which the first scan signal is shifted, and the third scan signal may be a signal from which the first scan signal is shifted.

It is to be understood that both the foregoing general description and the following detailed description are illustrative and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate illustrative embodiments of the invention, and together with the description serve to explain the inventive concepts.

DETAILED DESCRIPTION

Figure 1:
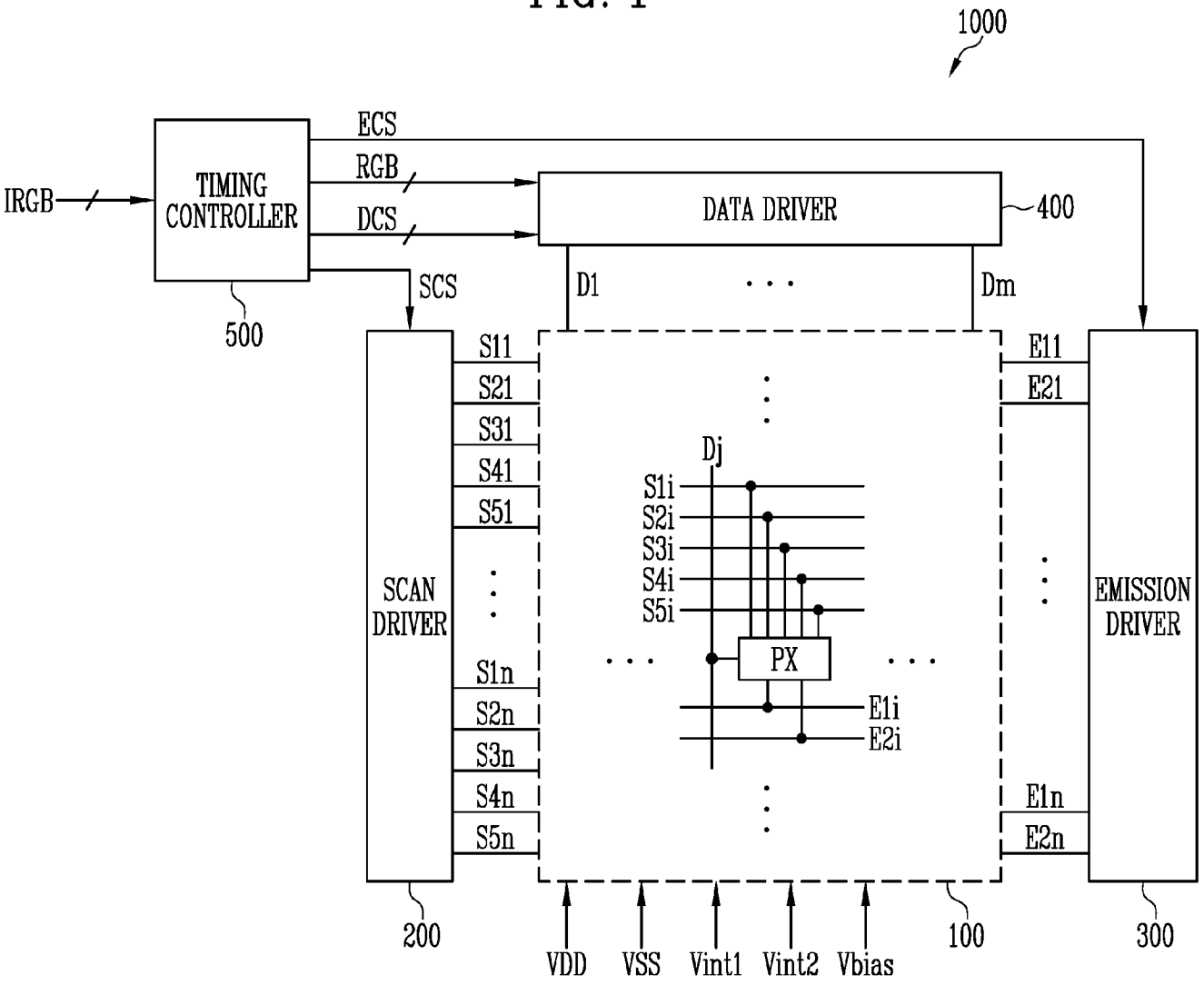
FIG. 1 is a block diagram illustrating a display device according to an embodiment that is constructed according to principles of the invention.

In the following description, for the purposes of explanation, numerous specific details are set forth in order to provide a thorough understanding of various embodiments or implementations of the invention. As used herein "embodiments" and "implementations" are interchangeable words that are non-limiting examples of devices or methods employing one or more of the inventive concepts disclosed herein. It is apparent, however, that various embodiments may be practiced without these specific details or with one or more equivalent arrangements. In other instances, well-known structures and devices are shown in block diagram form in order to avoid unnecessarily obscuring various embodiments. Further, various embodiments may be different, but do not have to be exclusive. For example, specific shapes, configurations, and characteristics of an embodiment may be used or implemented in another embodiment without departing from the inventive concepts.

Unless otherwise specified, the illustrated embodiments are to be understood as providing illustrative features of varying detail of some ways in which the inventive concepts may be implemented in practice. Therefore, unless otherwise specified, the features, components, modules, layers, films, panels, regions, and/or aspects, etc. (hereinafter individually or collectively referred to as "elements"), of the various embodiments may be otherwise combined, separated, interchanged, and/or rearranged without departing from the inventive concepts.

The use of cross-hatching and/or shading in the accompanying drawings is generally provided to clarify boundaries between adjacent elements. As such, neither the presence nor the absence of cross-hatching or shading conveys or indicates any preference or requirement for particular materials, material properties, dimensions, proportions, commonalities between illustrated elements, and/or any other characteristic, attribute, property, etc., of the elements, unless specified. Further, in the accompanying drawings, the size and relative sizes of elements may be exaggerated for clarity and/or descriptive purposes. When an embodiment may be implemented differently, a specific process order may be performed differently from the described order. For example, two consecutively described processes may be performed substantially at the same time or performed in an order opposite to the described order. Also, like reference numerals denote like elements.

When an element, such as a layer, is referred to as being "on," "connected to," or "coupled to" another element or layer, it may be directly on, connected to, or coupled to the other element or layer or intervening elements or layers may be present. When, however, an element or layer is referred to as being "directly on," "directly connected to," or "directly coupled to" another element or layer, there are no intervening elements or layers present. To this end, the term "connected" may refer to physical, electrical, and/or fluid connection, with or without intervening elements. For the purposes of this disclosure, "at least one of X, Y, and Z" and "at least one selected from the group consisting of X, Y, and Z" may be construed as X only, Y only, Z only, or any combination of two or more of X, Y, and Z, such as, for instance, XYZ, XYY, YZ, and ZZ. As used herein, the term "and/or" includes any and all combinations of one or more of the associated listed items.

Although the terms "first," "second," etc. may be used herein to describe various types of elements, these elements should not be limited by these terms. These terms are used to distinguish one element from another element. Thus, a first element discussed below could be termed a second element without departing from the teachings of the disclosure.

Spatially relative terms, such as "beneath," "below," "under," "lower," "above," "upper," "over," "higher," "side" (e.g., as in "sidewall"), and the like, may be used herein for descriptive purposes, and, thereby, to describe one elements relationship to another element(s) as illustrated in the drawings. Spatially relative terms are intended to encompass different orientations of an apparatus in use, operation, and/or manufacture in addition to the orientation depicted in the drawings. For example, if the apparatus in the drawings is turned over, elements described as "below" or "beneath" other elements or features would then be oriented "above" the other elements or features. Thus, the term "below" can encompass both an orientation of above and below. Furthermore, the apparatus may be otherwise oriented (e.g., rotated 90 degrees or at other orientations), and, as such, the spatially relative descriptors used herein interpreted accordingly.

The terminology used herein is for the purpose of describing particular embodiments and is not intended to be limiting. As used herein, the singular forms, "a," "an," and "the" are intended to include the plural forms as well, unless the context clearly indicates otherwise. Moreover, the terms "comprises," "comprising," "includes," and/or "including," when used in this specification, specify the presence of stated features, integers, steps, operations, elements, components, and/or groups thereof, but do not preclude the presence or addition of one or more other features, integers, steps, operations, elements, components, and/or groups thereof. It is also noted that, as used herein, the terms "substantially," "about," and other similar terms, are used as terms of approximation and not as terms of degree, and, as such, are utilized to account for inherent deviations in measured, calculated, and/or provided values that would be recognized by one of ordinary skill in the art.

As customary in the field, some embodiments are described and illustrated in the accompanying drawings in terms of functional blocks, units, and/or modules. Those skilled in the art will appreciate that these blocks, units, and/or modules are physically implemented by electronic (or optical) circuits, such as logic circuits, discrete components, microprocessors, hard-wired circuits, memory elements, wiring connections, and the like, which may be formed using semiconductor-based fabrication techniques or other manufacturing technologies. In the case of the blocks, units, and/or modules being implemented by microprocessors or other similar hardware, they may be programmed and controlled using software (e.g., microcode) to perform various functions discussed herein and may optionally be driven by firmware and/or software. It is also contemplated that each block, unit, and/or module may be implemented by dedicated hardware, or as a combination of dedicated hardware to perform some functions and a processor (e.g., one or more programmed microprocessors and associated circuitry) to perform other functions. Also, each block, unit, and/or module of some embodiments may be physically separated into two or more interacting and discrete blocks, units, and/or modules without departing from the scope of the inventive concepts. Further, the blocks, units, and/or modules of some embodiments may be physically combined into more complex blocks, units, and/or modules without departing from the scope of the inventive concepts.

Unless otherwise defined, all terms (including technical and scientific terms) used herein have the same meaning as commonly understood by one of ordinary skill in the art to which this disclosure is a part. Terms, such as those defined in commonly used dictionaries, should be interpreted as having a meaning that is consistent with their meaning in the context of the relevant art and should not be interpreted in an idealized or overly formal sense, unless expressly so defined herein.

Hereinafter, embodiments will be described in detail with reference to the accompanying drawings. The same reference numerals are used for the same components in the drawings, and repetitive description of the same components will be omitted for ease in explanation of the embodiments.

FIG. 1 is a block diagram illustrating a display device according to embodiments that is constructed according to principles of the invention.

Referring to FIG. 1, the display device 1000 according to an embodiment may include a pixel unit 100, a scan driver 200, an emission driver 300, a data driver 400, and a timing controller 500.

The display device 1000 may display an image at various frame frequencies (refresh rates, driving frequencies, or screen reproduction rates) according to a driving condition. The frame frequency may denote a frequency at which a data signal is substantially written to a driving transistor of a pixel PX included in the pixel unit 100 during one second. For example, the frame frequency may also be referred to as a screen scan rate or a screen reproduction frequency, and may indicate a frequency at which a display screen is reproduced during one second.

In an embodiment, an output frequency of a data signal of the data driver 400 and/or an output of a scan signal (for example, a fourth scan signal) supplied to a scan line (for example, a fourth scan line) to supply the data signal may be changed in response to the frame frequency. For example, a frame frequency for driving a moving image may be a frequency of about 60 Hz or higher (for example, 60 Hz, 120 Hz, 240 Hz, 360 Hz, 480 Hz, and the like). For example, when the frame frequency is 60 Hz, the fourth scan signal may be supplied to each horizontal line (pixel row) 60 times during one second.

In an embodiment, the display device 1000 may adjust output frequencies of the scan driver 200 and the emission driver 300 and the output frequency of the data driver 400 corresponding to the output frequencies of the scan driver 200 and the emission driver 300, according to a driving condition. For example, the display device 1000 may display an image in response to various frame frequencies of 1 Hz to 240 Hz. However, this is an example, and the display device 1000 may display an image also at a frame frequency of 240 Hz or higher (for example, 300 Hz or 480 Hz).

The pixel unit 100 may include scan lines S11 to S1*n*, S21 to S2*n*, S31 to S3*n*, S41 to S4*n*, and S51 to S5*n*, emission control lines E11 to E1*n* and E21 to E2*n*, and data lines D1 to Dm, and may include pixels PX connected thereto (where m and n are integers greater than 1). Each of the pixels PX may include a driving transistor and a plurality of switching transistors.

The timing controller 500 may receive input image data IRGB and control signals from a host system such as an application processor (AP) through a predetermined interface. The timing controller 500 may control a driving timing of the scan driver 200, the emission driver 300, and the data driver 400.

The timing controller 500 may generate a first control signal SCS, a second control signal ECS, and a third control signal DCS based on the input image data IRGB, the control signals, and the like. The first control signal SCS may be supplied to the scan driver 200, the second control signal ECS may be supplied to the emission driver 300, and the third control signal DCS may be supplied to the data driver 400. The timing controller 500 may rearrange the input image data IRGB to generate image data RGB and supply the image data RGB to the data driver 400.

The scan driver 200 may receive the first control signal SCS from the timing controller 500, and may supply a first scan signal, a second scan signal, a third scan signal, a fourth scan signal, and a fifth scan signal to first scan lines S11 to S1*n*, second scan lines S21 to S2*n*, third scan lines S31 to S3*n*, fourth scan lines S41 to S4*n*, and fifth scan lines S51 to S5*n*, respectively, based on the first control signal SCS.

The first to fifth scan signals may be set to a gate-on level voltage corresponding to a type of a transistor to which a corresponding scan signal is supplied. The transistor receiving the scan signal may be set to a turn-on state when the scan signal is supplied. For example, a gate-on level of a scan signal supplied to a P-channel metal oxide semiconductor (PMOS) transistor may be a logic low level, and a gate-on level of a scan signal supplied to an N-channel metal oxide semiconductor (NMOS) transistor may be a logic high level. Hereinafter, the phrase "supplying the scan signal" may be understood to denote that the scan signal is supplied at a logic level that turns on a transistor controlled by supply of the scan signal.

In an embodiment, the scan driver 200 may supply at least some of the first to fifth scan signals a plurality of times during a non-emission period. Accordingly, a bias state of the driving transistor included in the pixel PX may be controlled.

The emission driver 300 may supply a first emission control signal and a second emission control signal to first emission control lines E11 to E1*n* and second emission control lines E21 to E2*n*, respectively, based on the second control signal ECS.

The first and second emission control signals may be set to a gate-off level voltage (for example, a high voltage). A transistor receiving the first emission control signal or the second emission control signal may be turned off when the first emission control signal or the second emission control signal is supplied, and may be turned off in other cases. Hereinafter, the phrase "the emission control signal is supplied" may be understood to denote that the emission control signal is supplied at a logic level (for example, a logic high level) that turns off a transistor controlled by supply of the emission control signal.

In FIG. 1, each of the scan driver 200 and the emission driver 300 is shown as a single configuration for convenience of description, but the embodiment described herein is not limited thereto. According to a design, the scan driver 200 may include a plurality of scan drivers that respectively supply at least one of the first to fifth scan signals. In addition, at least a portion of the scan driver 200 and the emission driver 300 may be integrated into one driving circuit, module, or the like.

The data driver 400 may receive the third control signal DCS and the image data RGB from the timing controller 500. The data driver 400 may convert digital image data RGB into an analog data signal (or data voltage). The data driver 400 may supply a data signal to the data lines D1 to Dm in response to the third control signal DCS. At this time, the data signal supplied to the data lines D1 to Dm may be supplied to be synchronized with an output timing of the fourth scan signal supplied to the fourth scan lines S41 to S4*n*.

In an embodiment, the display device 1000 may further include a power supply. The power supply may supply a first power voltage VDD, a second power voltage VSS, a third power voltage Vint1 (for example, a first initialization voltage), a fourth power voltage Vint2 (for example, a second initialization voltage), and a fifth power voltage Vbias (for example, a bias voltage) for driving the pixel PX to the pixel unit 100.

The display device 1000 may operate at various frame frequencies. Here, in a case of low-frequency driving in which the display device 1000 is driven at a relatively low frame frequency (for example, a frame frequency of 60 Hz or less), an image defect such as flicker may be recognized due to current leakage inside the pixel. In addition, an afterimage such as image drag may be recognized according to a bias state change of the driving transistor by driving at various frame frequencies, and a response speed change due to a threshold voltage shift or the like according to a hysteresis characteristic change.

In order to improve image quality, one frame period may include a plurality of non-emission periods and emission periods according to the frame frequency. For example, initial non-emission period and emission period of one frame may be defined as a first driving period, and subsequent non-emission period and emission period may be defined as a second driving period.

For example, a data signal for displaying an image may be substantially written to the pixel PX in the first driving period, and an on-bias may be applied to the driving transistor of the pixel PX in the second driving period.

In a case of high-frequency driving in which the display device 1000 is driven at a relatively high frame frequency (for example, a frame frequency of 120 Hz or higher), a threshold voltage compensation time of the driving transistor is required to be sufficiently secured in order to implement image quality of a minimum standard. The pixel PX and the display device 1000 according to embodiments may display a high-quality image at various frame frequencies while securing sufficient threshold voltage compensation time.

Figure 2:
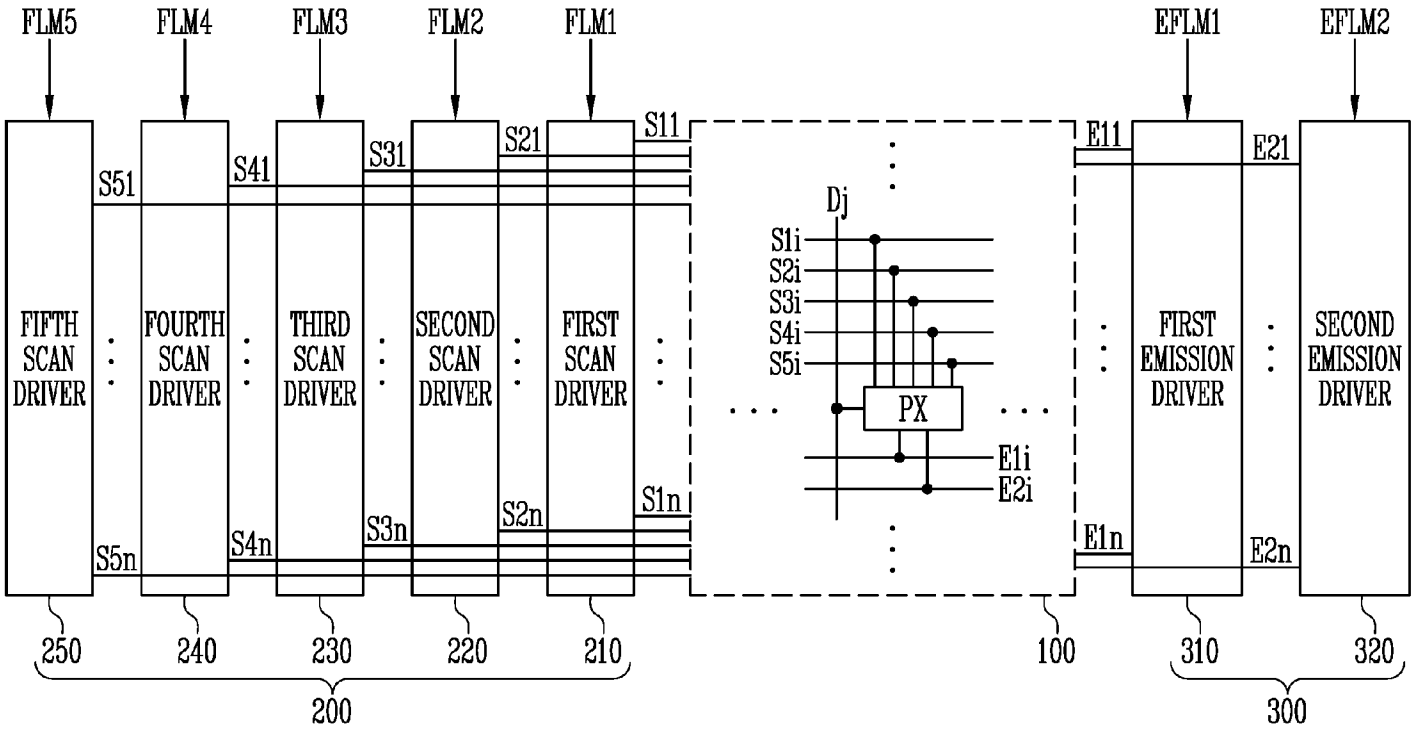
FIG. 2 is a diagram illustrating an example of a scan driver and an emission driver included in the display device of FIG. 1.

FIG. 2 is a diagram illustrating an example of the scan driver and the emission driver included in the display device of FIG. 1.

Referring to FIGS. 1 and 2, the scan driver 200 may include a first scan driver 210, a second scan driver 220, a third scan driver 230, a fourth scan driver 240, and fifth scan driver 250.

In an embodiment, each of the first to fifth scan drivers 210, 220, 230, 240, and 250 may include dependently connected stage circuits.

The first control signal SCS may include first to fifth scan start signals FLM1 to FLM5. The first to fifth scan start signals FLM1 to FLM5 may be supplied to the first to fifth scan drivers 210, 220, 230, 240, and 250, respectively.

A width, a supply timing, and the like of the first to fifth scan start signals FLM1 to FLM5 may be determined according to a driving condition and a frame frequency of the pixel PX.

The first to fifth scan signals may be output based on the first to fifth scan start signals FLM1 to FLM5, respectively. For example, a signal width of at least one of the first to fifth scan signals may be different from a signal width of the remaining scan signals. In addition, at least one of the first to fifth scan signals may be output a plurality of times during the non-emission period.

Furthermore, gate-on levels of the first to fifth scan signals may be determined according to types of corresponding transistors, respectively.

The first scan driver 210 may supply the first scan signal to the first scan lines S11 to S1*n* in response to the first scan start signal FLM1. The second scan driver 220 may supply the second scan signal to the second scan lines S21 to S2*n* in response to the second scan start signal FLM2. The third scan driver 230 may supply the third scan signal to the third scan lines S31 to S3*n* in response to the third scan start signal FLM3. The fourth scan driver 240 may supply the fourth scan signal to the fourth scan lines S41 to S4*n* in response to the fourth scan start signal FLM4. The fifth scan driver 250 may supply the fifth scan signal to the fifth scan lines S51 to S5*n* in response to the fifth scan start signal FLM5.

In an embodiment, the emission driver 300 may include a first emission driver 310 and a second emission driver 320.

The second control signal ECS may include first and second emission control start signals EFLM1 and EFLM2. The first and second emission control start signals EFLM1 and EFLM2 may be supplied to the first and second emission drivers 310 and 320, respectively.

In an embodiment, each of the first and second emission drivers 310 and 320 may include dependently connected stage circuits. In addition, a pulse width, a supply timing, and the like of the first emission control signal may be different from those of the second emission control signal.

The first emission driver 310 may supply the first emission control signal to the first emission control lines E11 to E1*n* in response to the first emission control start signal EFLM1. The second emission driver 320 may supply the second emission control signal to the second emission control lines E21 to E2*n* in response to the second emission control start signal EFLM2.

Figure 3:
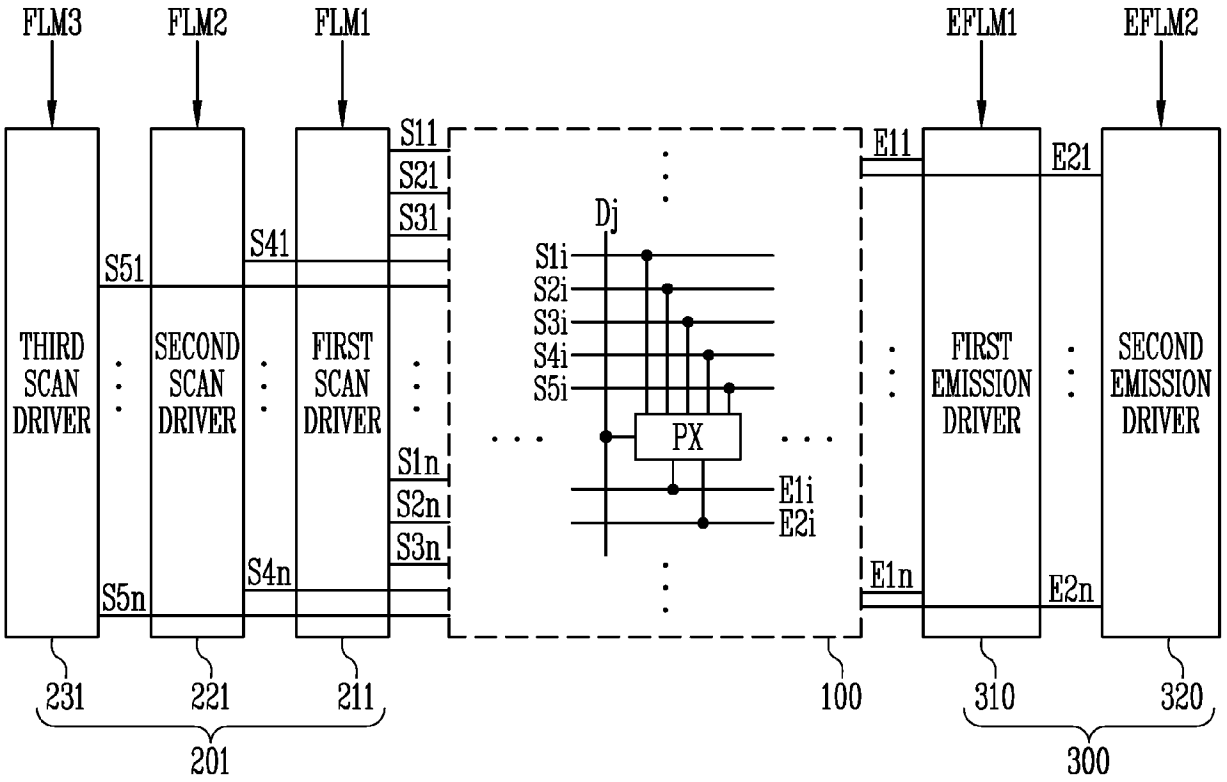
FIG. 3 is a diagram illustrating an example of the scan driver and the emission driver included in the display device of FIG. 1.

FIG. 3 is a diagram illustrating an example of the scan driver and the emission driver included in the display device of FIG. 1.

In FIG. 3, except for a scan driver 201, since the contents of FIG. 3 are substantially the same as or similar to those described with reference to FIG. 2, same reference numerals are used for the same or corresponding components in the following description, and repetitive description is omitted for ease in explanation of FIG. 3.

Referring to FIGS. 1 and 3, the scan driver 201 may include a first scan driver 211, a second scan driver 221, and a third scan driver 231.

In an embodiment, the first scan driver 211 may supply the first scan signal to the first scan lines S11 to S1*n* based on the first scan start signal FLM1, supply the second scan signal to the second scan lines S21 to S2*n*, and supply the third scan signal to the third scan lines S31 to S3*n*.

Here, a pulse width of the second scan signal may be the same as a pulse width of the first scan signal. For example, the second scan signal supplied to the same pixel may be a signal from which the first scan signal is shifted. For example, a second scan line (for example, S2*i*) connected to an i-th pixel row (where i is a positive integer greater than or equal to one, i.e., a natural number) may be connected to a first scan line (for example, S1*i*+1) connected to an (i+1)-th pixel row.

In addition, a pulse width of the third scan signal may be the same as a pulse width of the first scan signal. For example, the third scan signal supplied to the same pixel may be a signal from which the first scan signal is shifted. For example, a third scan line (for example, S3*i*) connected to the i-th pixel row may be connected to a first scan line (for example, S1*i*+k) connected to an (i+k)-th (where k is a natural number) pixel row.

Accordingly, a size of the scan driver 201 included in the display device 1000 may be reduced, line complexity of the display device 1000 may be improved, and a manufacturing cost may be reduced.

However, this is only an example, and the first scan signal and the third scan signal may be output from different scan drivers. For example, the first scan driver 211 may supply the first scan signal to the first scan lines S11 to S1*n*, and an additional scan driver may supply the third scan signal to the third scan lines S31 to S3*n*.

Figure 4:
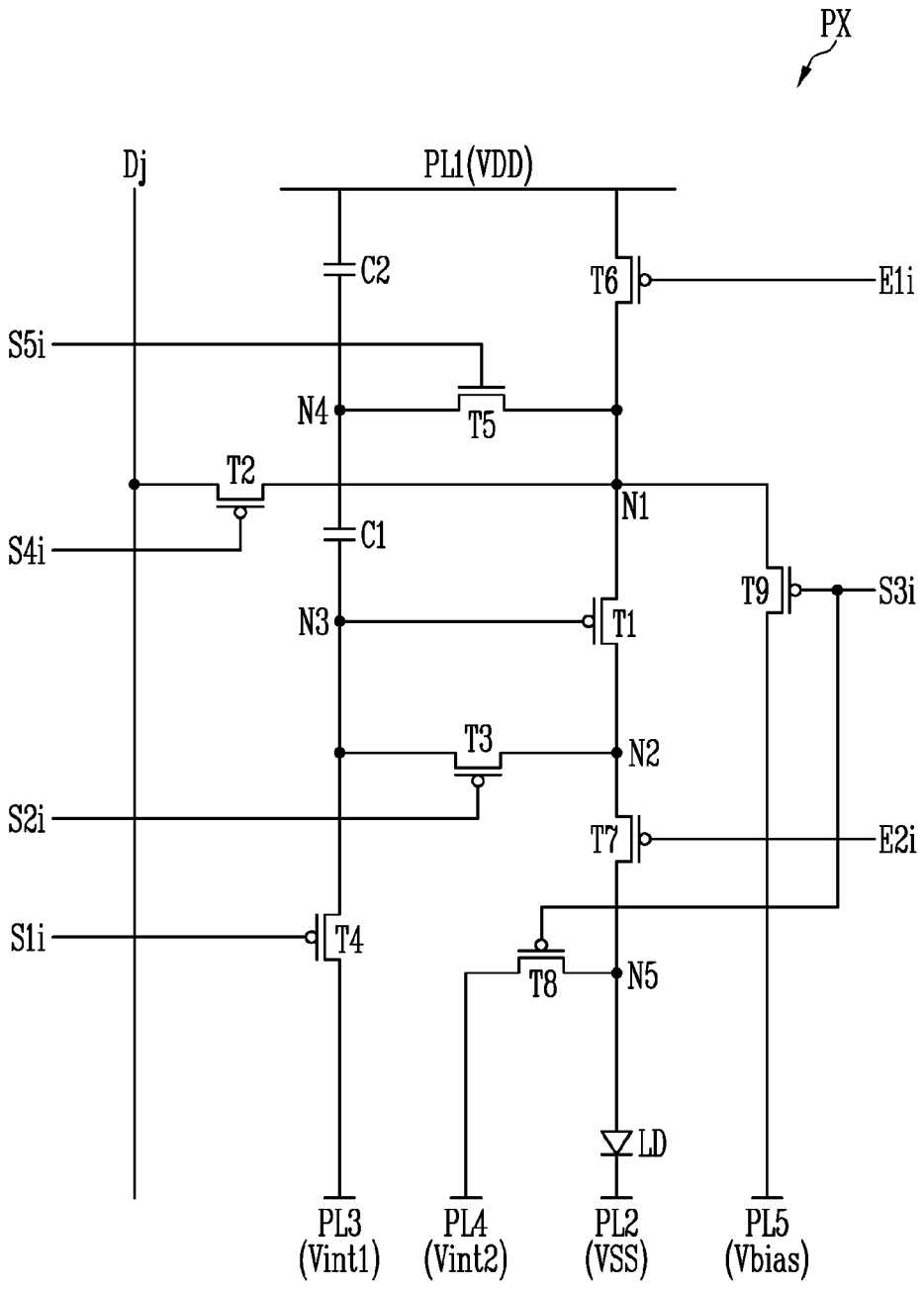
FIG. 4 is a circuit diagram illustrating an example of a pixel included in the display device of FIG. 1.

FIG. 4 is a circuit diagram illustrating an example of the pixel included in the display device of FIG. 1.

In FIG. 4, for convenience of description, a pixel PX positioned on an i-th horizontal line (or the i-th pixel row) and connected to a j-th data line Dj is shown (where i and j are positive integers greater than or equal to one, i.e., natural numbers).

Referring to FIGS. 1 and 4, the pixel PX may include a light emitting element LD, first to ninth transistors T1 to T9, a first capacitor C1 (or a storage capacitor), and a second capacitor C2 (or a holding capacitor).

A first electrode (for example, an anode electrode) of the light emitting element LD may be connected to a fifth node N5, and a second electrode (for example, a cathode electrode) of the light emitting element LD may be connected to a second line PL2 transferring a second power voltage VSS. The light emitting element LD may generate light of a predetermined luminance in response to a current amount supplied from the first transistor T1.

The second power line PL2 may have a line shape, but is not limited thereto. For example, the second power line PL2 may be a conductive layer of a conductive plate shape.

In an embodiment, the light emitting element LD may be an organic light emitting diode including an organic light emitting layer. In another embodiment, the light emitting element LD may be an inorganic light emitting diode formed of an inorganic material, such as a micro light emitting diode (LED) or a quantum dot light emitting diode. In another embodiment, the light emitting element LD may be a light emitting element configured of an organic material and an inorganic material in combination.

In FIG. 4, the pixel PX includes a single light emitting element LD, but in another embodiment, the pixel PX may include a plurality of light emitting elements, and the plurality of light emitting elements may be connected in series, in parallel, or in series-parallel each other. For example, the light emitting element LD may have a shape in which a plurality of light emitting elements (for example, organic light emitting elements and/or inorganic light emitting elements) are connected in series, in parallel, or in series-parallel between the second power line PL2 and the fifth node N5.

A first electrode of the first transistor T1 (or a driving transistor) may be connected to a first node N1, and a second electrode may be connected to a second node N2. A gate electrode of the first transistor T1 may be connected to a third node N3. The first transistor T1 may control a driving current flowing from a first power line PL1 providing the first power voltage VDD to a second power line PL2 providing the second power voltage VSS via the light emitting element LD in response to a voltage of the third node N3. For example, the first power voltage VDD may be set to a voltage higher than the second power voltage VSS. For example, the first power voltage VDD may be a positive voltage, and the second power voltage VSS may be a negative voltage.

The second transistor T2 may be connected between the j-th data line Dj (hereinafter, referred to as a data line) and the first node N1. A gate electrode of the second transistor T2 may be connected to an i-th fourth scan line S4*i* (hereinafter, referred to as a fourth scan line). The second transistor T2 may be turned on when the fourth scan signal is supplied to the fourth scan line S4*i* to electrically connect the data line Dj and the first node N1.

The third transistor T3 may be connected between the second electrode (or the second node N2) of the first transistor T1 and the gate electrode (or the third node N3). A gate electrode of the third transistor T3 may be connected to an i-th second scan line S2*i* (hereinafter, referred to as a second scan line).

The third transistor T3 may be turned on when the second scan signal is supplied to the second scan line S2*i* to electrically connect the second electrode and the gate electrode of the first transistor T1 (or the second node N2 and the third node N3). That is, a timing at which the second electrode (for example, the drain electrode) of the first transistor T1 and the gate electrode of the first transistor T1 are connected may be controlled by supply of the second scan signal. When the third transistor T3 is turned on, the first transistor T1 may be connected in a diode form.

The fourth transistor T4 may be connected between the third node N3 and a third power line PL3 providing the third power voltage Vint1 (for example, the first initialization voltage). A gate electrode of the fourth transistor T4 may be connected to an i-th first scan line S1*i* (hereinafter, referred to as a first scan line).

The fourth transistor T4 may be turned on when the first scan signal is supplied to the first scan line S1*i* to supply the third power voltage Vint1 to the third node N3. For example, the third power voltage Vint1 may be set to a voltage lower than a lowest level of the data signal supplied to the data line Dj.

The fourth transistor T4 may be turned on by supply of the first scan signal to initialize the third node N3 (or the gate electrode of the first transistor T1) to the third power voltage Vint1.

The fifth transistor T5 may be connected between the first node N1 and a fourth node N4. A gate electrode of the fifth transistor T5 may be connected to an i-th fifth scan line S5*i* (hereinafter, referred to as a fifth scan line).

The fifth transistor T5 may be turned on when the fifth scan signal is supplied to the fifth scan line S5*i* to supply the first power voltage VDD or a voltage of the data signal to the fourth node N4.

In an embodiment, the fifth transistor T5 may be an oxide semiconductor transistor. The fifth transistor T5 may include an oxide semiconductor layer as an active layer (a semiconductor layer, or a channel layer). For example, the fifth transistor T5 may be an n-type oxide semiconductor transistor.

The oxide semiconductor transistor may be processed at a low temperature and has a charge mobility lower than that of a polysilicon semiconductor transistor. That is, the oxide semiconductor transistor has excellent an off current characteristic. Therefore, when the fifth transistor T5 is configured of an oxide semiconductor transistor, leakage current through the fifth transistor T5 due to low-frequency driving and variable frequency driving may be minimized, and thus display quality may be improved.

The sixth transistor T6 may be connected between the first power line PL1 and the first node N1. A gate electrode of the sixth transistor T6 may be connected to an i-th first emission control line E1*i* (hereinafter, referred to as a first emission control line).

The sixth transistor T6 may be turned off when the first emission control signal is supplied to the first emission control line E1*i*, and may be turned on in other cases. When the sixth transistor T6 is turned on, the first node N1 may be electrically connected to the first power line PL1.

The seventh transistor T7 may be connected between the second node N2 and the fifth node N5 (or the first electrode of the light emitting element LD). A gate electrode of the seventh transistor T7 may be connected to an i-th second emission control line E2*i* (hereinafter, referred to as a second emission control line).

The seventh transistor T7 may be turned off when the second emission control signal is supplied to the second emission control line E2*i*, and may be turned on in other cases. When the seventh transistor T7 is turned on, the second node N2 and the fifth node N5 may be electrically connected.

The eighth transistor T8 may be connected between the fifth node N5 and a fourth power line PL4 providing the fourth power voltage Vint2 (for example, the second initialization voltage). A gate electrode of the eighth transistor T8 may be connected to an i-th third scan line S3*i* (hereinafter, referred to as a third scan line).

The eighth transistor T8 may be turned on when the third scan signal is supplied to the third scan line S3*i* to supply the fourth power voltage Vint2 to the fifth node N5.

When the fourth power voltage Vint2 is supplied to the first electrode (or the fifth node N5) of the light emitting element LD by supply of the third scan signal, a parasitic capacitor of the light emitting element LD may be discharged. At this time, as a residual voltage charged in the parasitic capacitor is discharged (removed), unintentional fine light emission may be prevented. Therefore, black expression ability of the pixel PX may be improved.

The third power voltage Vint3 and the fourth power voltage Vint2 may be different from each other. That is, a voltage for initializing the third node N3 (or the gate electrode of the first transistor T1) and a voltage for initializing the fifth node N5 (or the first electrode of the light emitting element LD) may be set to be different from each other.

In low-frequency driving in which a length of one frame period is increased, when the third power voltage Vint1 supplied to the third node N3 (or the gate electrode of the first transistor T1) is excessively low, since a strong on-bias is applied to the first transistor T1, a case in which a threshold voltage of the first transistor T1 is shifted in a corresponding frame period may occur. Such a hysteresis characteristic of the first transistor T1 may cause a flicker phenomenon in low-frequency driving. Therefore, the third power voltage Vint3 higher than the second power voltage VSS may be required in the display device of low-frequency driving.

Alternatively, when the fourth power voltage Vint2 supplied to the fifth node N5 (or the first electrode of the light emitting element LD) becomes higher than a predetermined reference, the voltage of the parasitic capacitor of the light emitting element LD may not be discharged and may be charged rather. Therefore, the fourth power voltage Vint2 lower than the second power voltage VSS may be required.

However, this is an example, and the third power voltage Vint1 and the fourth power voltage Vint2 may be variously set. For example, the third power voltage Vint1 and the fourth power voltage Vint2 may be substantially the same.

The ninth transistor T9 may be connected between the first node N1 (or the first electrode of the first transistor T1) and a fifth power line PL5 providing the fifth power voltage Vbias (for example, the bias voltage). A gate electrode of the ninth transistor T9 may be connected to the third scan line S3*i*.

The ninth transistor T9 may be turned on when the third scan signal is supplied to the third scan line S3*i* to supply the fifth power voltage Vbias to the first node N1. In an embodiment, the fifth power voltage Vbias may have a level similar to a voltage level of a data signal of a black grayscale. For example, the fifth power voltage Vbias may have a voltage level of about 5 to 7V.

Accordingly, a predetermined high voltage may be applied to the first electrode (for example, a source electrode) of the first transistor T1 by the turn-on of the ninth transistor T9. At this time, when the third transistor T3 is in a turn-off state, the first transistor T1 may have an on-bias state (a state in which the first transistor T1 may be turned on) (that is, the first transistor T1 may be on-biased).

Here, as the fifth power voltage Vbias is periodically supplied to the first node N1, the bias state of the first transistor T1 may be periodically changed, and a threshold voltage characteristic of the first transistor T1 may be changed. Therefore, a characteristic of the first transistor T1 may be fixed to a specific state, and the first transistor T1 may be prevented from being deteriorated in the low-frequency driving.

The first capacitor C1 may be connected between the third node N3 and the fourth node N4. The first capacitor C1 may store a voltage difference between the third node N3 and the fourth node N4.

The second capacitor C2 may be connected between the first power line PL1 and the fourth node N4. As one electrode of the second capacitor C2 is connected to the first power line PL1, the first power voltage VDD, which is a constant voltage, may be continuously supplied to the one electrode of the second capacitor C2. Therefore, a voltage of the fourth node N4 may not be affected by other parasitic capacitors and may be maintained as voltage levels directly supplied to the fourth node N4. That is, the second capacitor C2 may function as a holding capacitor.

Some transistors of the pixel PX may be polysilicon semiconductor transistors. For example, the first, second, third, fourth, sixth, seventh, eighth, and ninth transistors T1, T2, T3, T4, T6, T7, T8, and T9 may include a polysilicon semiconductor layer formed through a low temperature poly-silicon (LTPS) process as an active layer (a semiconductor layer, or a channel layer). Since the polysilicon semiconductor transistor has an advantage of a fast response speed, the polysilicon semiconductor transistor may be applied to a switching element requiring fast switching.

However, this is an example, and types and kinds of transistors are not limited to the above-described example.

Figure 5A:
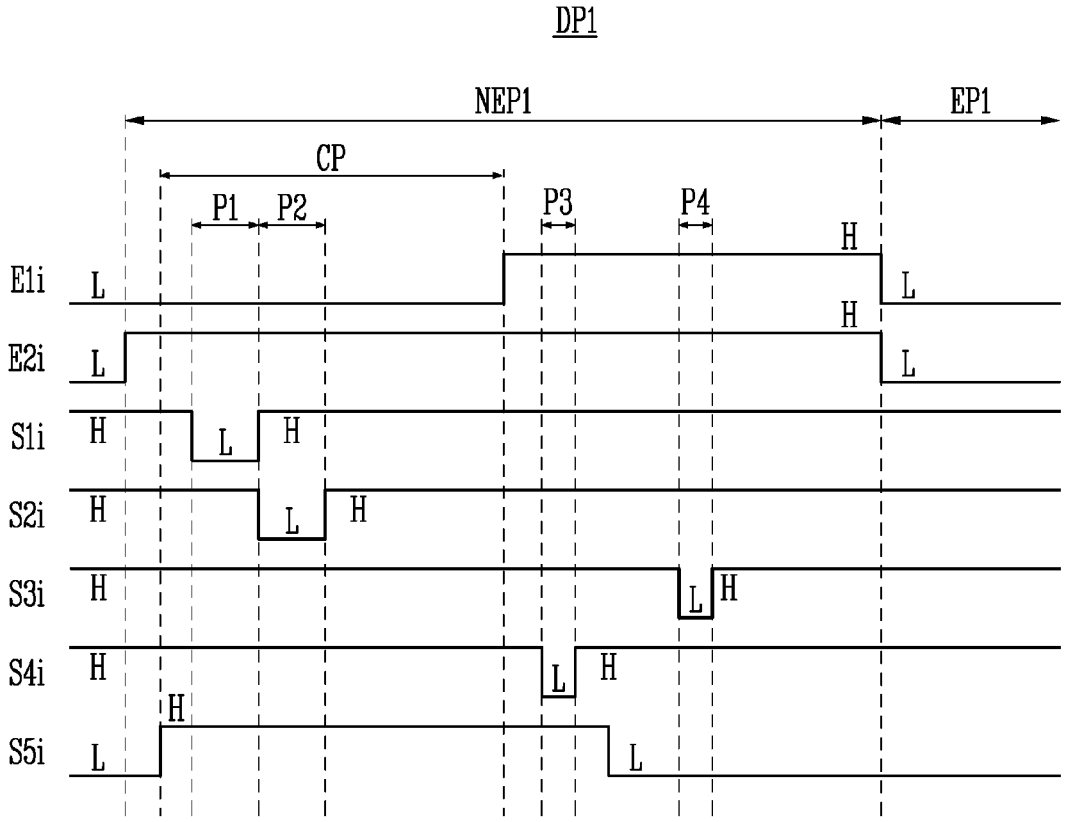
FIGS. 5A to 5C are timing diagrams illustrating an example of signals supplied to the pixel of FIG. 4 in a first driving period.
Figure 5B:
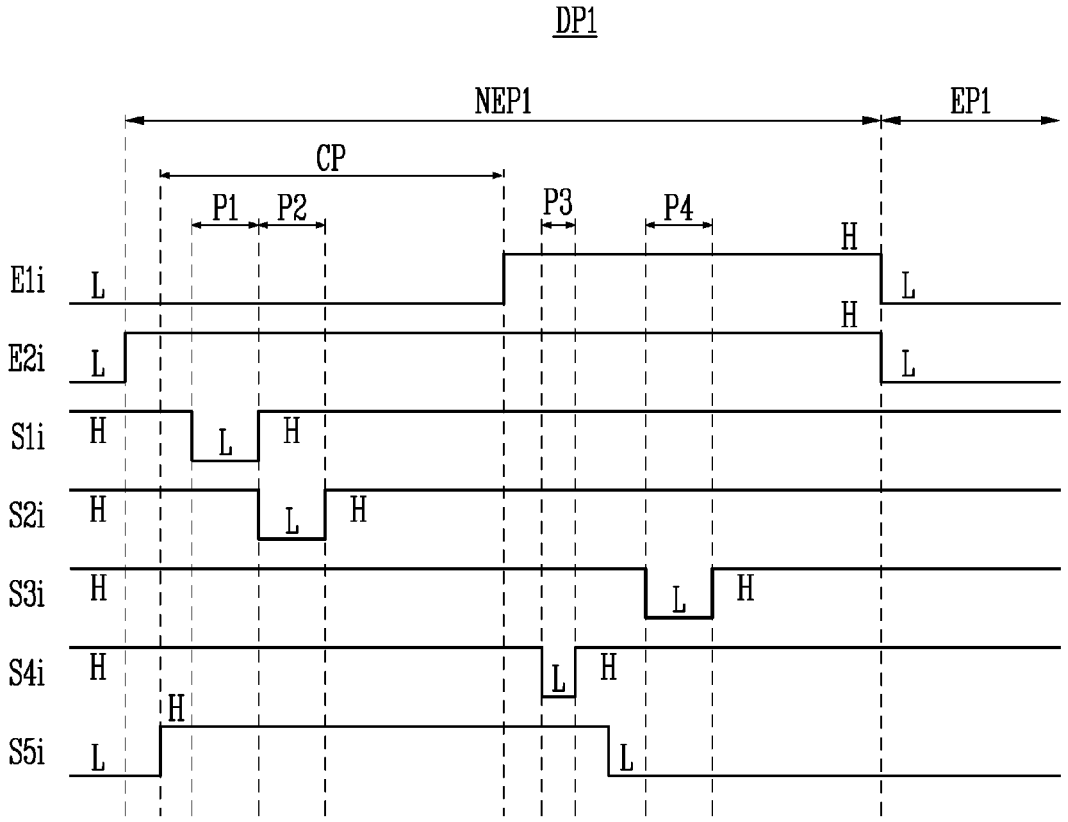
Figure 5C:
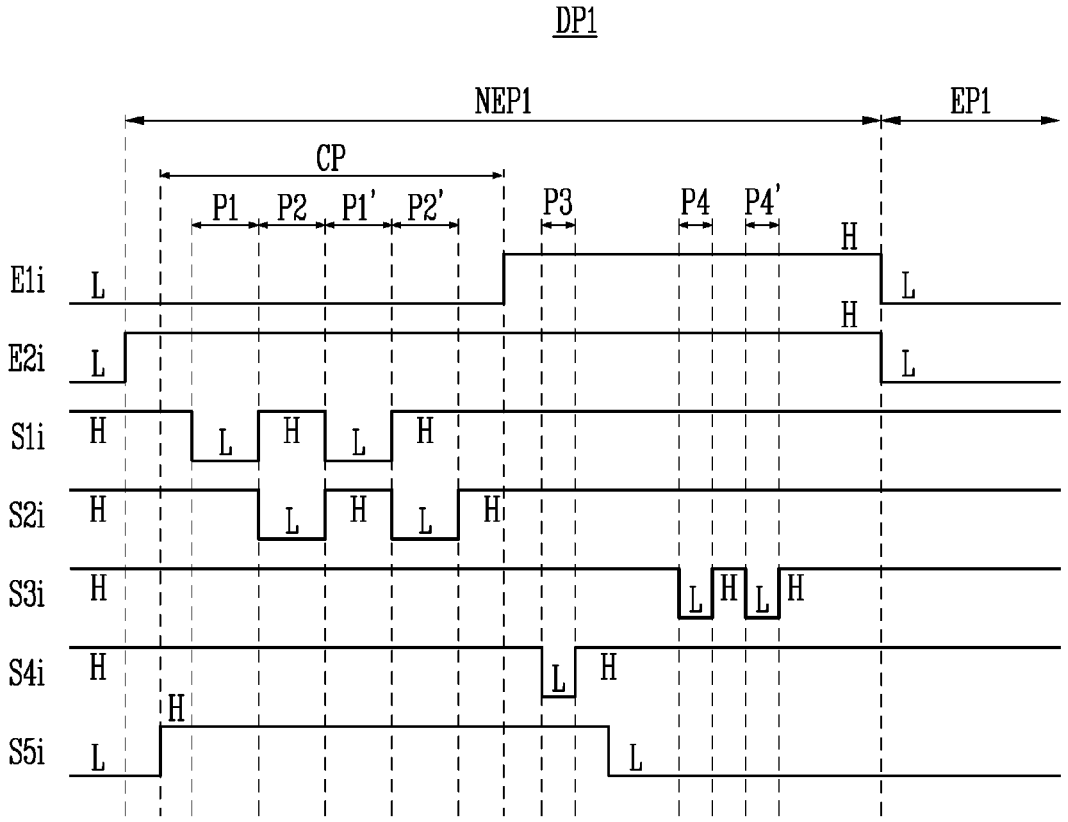
Figure 6A:
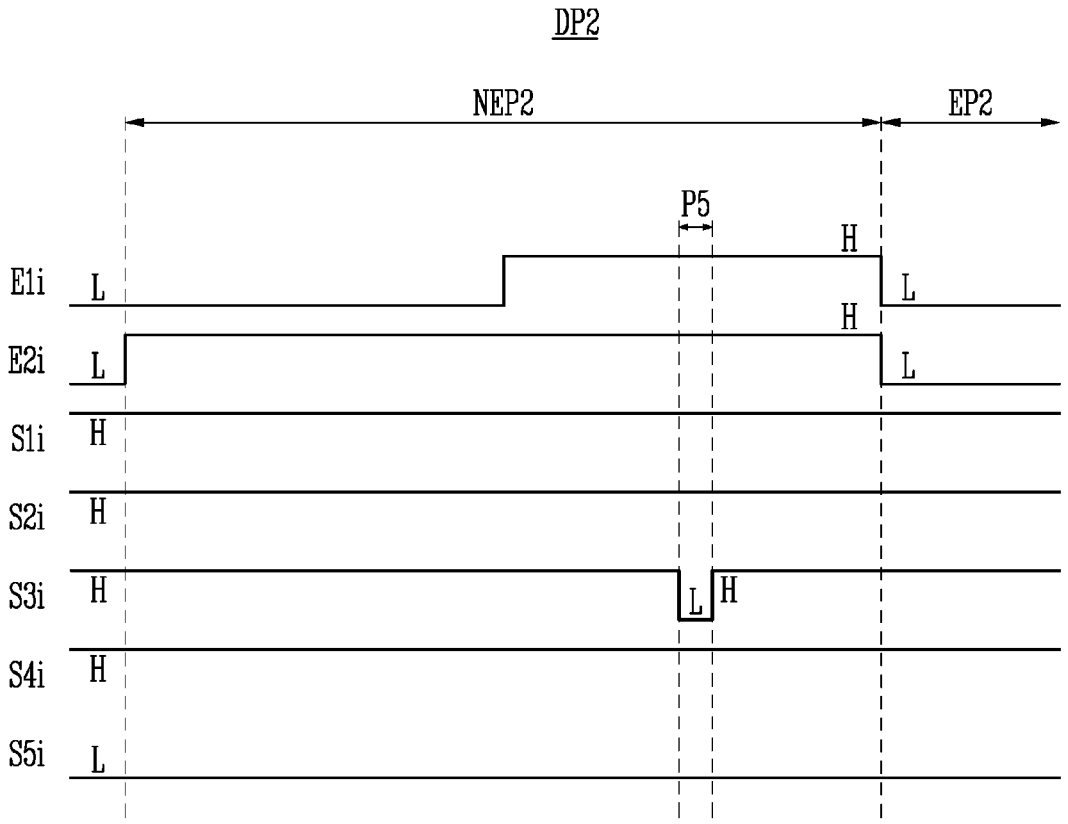
FIGS. 6A and 6B are timing diagrams illustrating an example of signals supplied to the pixel of FIG. 4 in a second driving period.
Figure 6B:
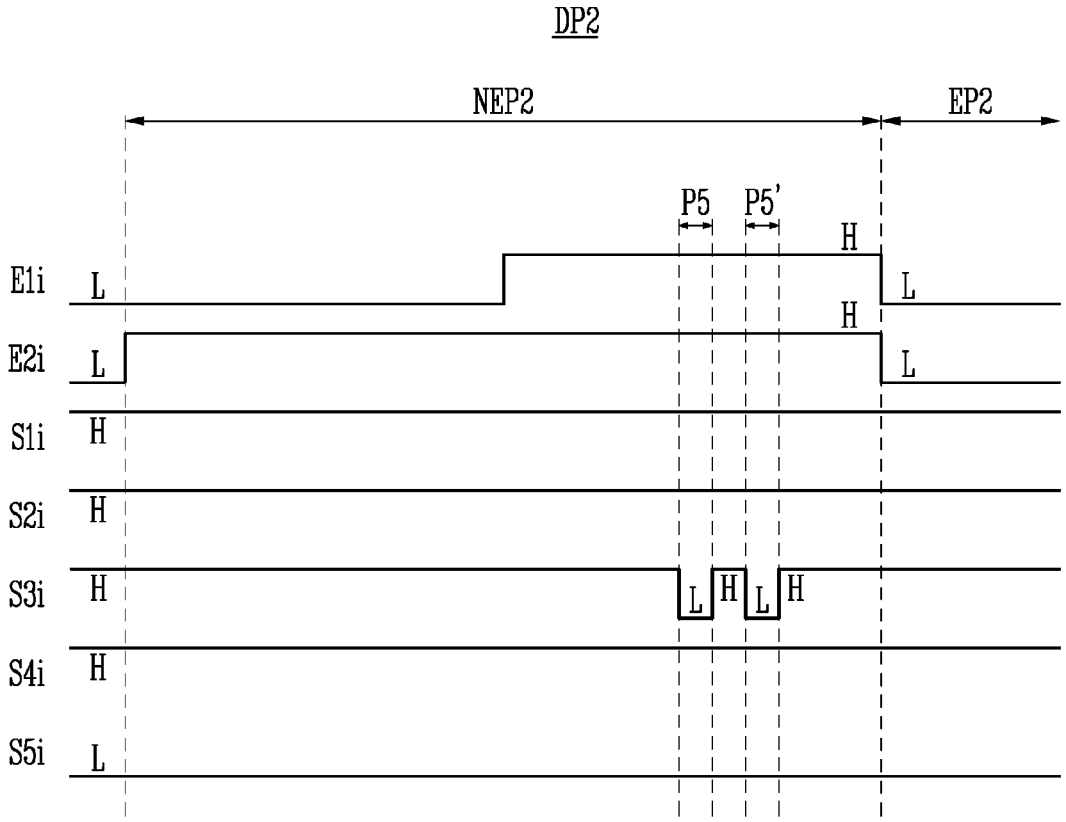

FIGS. 5A to 5C are timing diagrams illustrating an example of signals supplied to the pixel of FIG. 4 in the first driving period, and FIGS. 6A and 6B are timing diagrams illustrating an example of signals supplied to the pixel of FIG. 4 in the second driving period.

Referring to FIGS. 4, 5A, and 6A, the pixel PX may operate during a first driving period DP1 or a second driving period DP2.

In variable frequency driving for controlling the frame frequency, one frame period may include the first driving period DP1. In addition, the second driving period DP2 may be omitted or may proceed at least once according to the frame frequency.

The first driving period DP1 may include a first non-emission period NEP1 and a first emission period EP1. The second driving period DP2 may include a second non-emission period NEP2 and a second emission period EP2. Here, the first and second non-emission periods NEP1 and NEP2 may denote a period in which a path of the driving current flowing from the first power line PL1 to the second power line PL2 via the light emitting element LD is blocked, and the first and second emission periods EP1 and EP2 may denote a period in which the path of the driving current is formed and the light emitting element LD emits light based on the driving current.

The first driving period DP1 may include a period in which a data signal actually corresponding to an output image is written (for example, a third period P3). In the second driving period DP2, the data signal may not be supplied, and the third scan signal may be supplied to control the first transistor T1 of the pixel PX to be in the on-bias state and initialize the light emitting element LD.

As shown in FIG. 5A, the first non-emission period NEP1 may include first to fourth periods P1 to P4 and a compensation period CP. Here, the first period P1 and the second period P2 may overlap the compensation period CP.

In an embodiment, a width of the fifth scan signal may be greater than a width of each of the first to fourth scan signals.

In an embodiment, a width of the second scan signal supplied to the second scan line S2*i* may be the same as a width of the first scan signal supplied to the first scan line S1*i*. For example, the second scan signal may be a signal from which the first scan signal is shifted, and a width of a period (for example, the second period P2) in which the second scan signal is maintained as a low level L (or a gate-on level) and a width of a period (for example, the first period P1) in which the first scan signal is maintained as a low level L (or a gate-on level) may be the same. For example, as described with reference to FIG. 3, the second scan line S2*i* may share the scan signal with the first scan line (for example, S1*i*+1 described with reference to FIG. 3) of the (i+1)-th pixel row.

In FIG. 5A, a width of the third scan signal supplied to the third scan line S3*i* is different from the width of the first scan signal supplied to the first scan line S1*i* (for example, the width of the third scan signal is less than the width of the first scan signal), but the embodiment is not limited thereto.

For example, as shown in FIG. 5B, the width of the third scan signal supplied to the third scan line S3*i* may be the same as the width of the first scan signal supplied to the first scan line S1*i*. For example, the third scan signal may be a signal from which the first scan signal is shifted, and a width of a period (for example, the fourth period P4) in which the third scan signal is maintained as a low level L (or a gate-on level) and a width of the period (for example, the first period P1) in which the first scan signal is maintained as a low level L (or a gate-on level) may be the same. As an example, as described with reference to FIG. 3, the third scan line S3*i* may share the scan signal with the first scan line (for example, S1*i*+k described with reference to FIG. 3) of the (i+k)-th pixel row.

As described above, as the second scan line S2*i* and/or the third scan line S3*i* share the scan signal with the first scan line S1*i*, line complexity of the display device 1000 (refer to FIG. 1) may be improved, and manufacturing cost may be reduced.

The fifth scan signal supplied to the n-type oxide semiconductor transistor (for example, the fifth transistor T5) may have a high level H, and the first to fourth scan signals supplied to the p-type polysilicon semiconductor transistors (for example, the second, third, fourth, eighth, and ninth transistors T2, T3, T4, T8, and T9) may have a low level L.

In an embodiment, a waveform of the first emission control signal may be different from a waveform of the second emission control signal in the first non-emission period NEP1. For example, a width of the second emission control signal may be greater than a width of the first emission control signal.

The first emission control signal may maintain a low level L from a time point at which the first non-emission period NEP1 starts to a time point at which the compensation period CP ends, and in this period, the sixth transistor T6 may maintain a turn-on state by the first emission control signal of a low level L (or a gate-on level). In addition, the first emission control signal may maintain a high level H after the compensation period CP until the first non-emission period NEP1 ends, and in this period, the sixth transistor T6 may maintain a turn-off state by the first emission control signal of a high level H (or a gate-off level).

In addition, the second emission control signal may maintain a high level H (or a gate-off level) during the first non-emission period NEP1. Accordingly, since the seventh transistor T7 maintains a turn-off state during the first non-emission period NEP1, the path of the driving current flowing from the first power line PL1 to the second power line PL2 via the light emitting element LD may be blocked during the first non-emission period NEP1.

In the compensation period CP of the first non-emission period NEP1, the first emission control signal may maintain a low level L (or a gate-on level), and the fifth scan signal may maintain a high level H (or a gate-on level). Accordingly, the fifth and sixth transistors T5 and T6 may maintain a turn-on state during the compensation period CP. Therefore, since a current path through which the first power voltage VDD reaches the fourth node N4 from the first power line PL1 via the sixth transistor T6 and the fifth transistor T5 is formed, the first power voltage VDD may be supplied to the fourth node N4 during the compensation period CP. Accordingly, the voltage of the data signal of the previous frame may be removed at the fourth node N4.

Supply of the fifth scan signal may be maintained to a time point at which the fourth period P4 starts. That is, the fifth scan signal may maintain the high level H to the time point at which the fourth period P4 starts.

The first scan signal may be supplied to the first scan line S1*i* during the first period P1 of the compensation period CP. For example, a first scan signal of a low level L (or a gate-on level) may be supplied to the first scan line S1*i* in the first period P1. Accordingly, the fourth transistor T4 may be turned on.

In FIG. 5A, the first scan signal is supplied after the fifth scan signal is supplied, an embodiment is not limited thereto. For example, a time point at which the fifth scan signal is supplied (that is, a time point at which the fifth scan signal transits to a high level H) and a time point at which the first scan signal is supplied (that is, a time point at which the first scan signal transits to a low level L) may be the same. That is, a time point at which the compensation period CP starts and a time point at which the first period P1 starts may be the same.

Since the fourth transistor T4 is turned on in the first period P1, the third power voltage Vint1 may be supplied to the third node N3. Therefore, the voltage of the third node N3 (that is, the voltage of the gate electrode of the first transistor T1) may be initialized to the third power voltage Vint1. The first period P1 may be a period for initializing the voltage of the third node N3 and may be understood as a first initialization period.

During the second period P2 of the compensation period CP, the second scan signal may be supplied to the second scan line S2*i*, and supply of the first scan signal to the first scan line S1*i* may be stopped. For example, in the second period P2, a second scan signal of a low level L (or a gate-on level) may be supplied to the second scan line S2*i* and a first scan signal of a high level H (or a gate-off level) may be supplied. Accordingly, the third transistor T3 may be turned on and the fourth transistor T4 may be turned off. At this time, since the fifth transistor T5 is in a turn-on state, the first power voltage VDD may be maintained at the fourth node N4.

Since the third transistor T3 is in a turn-on state, the first transistor T1 may be connected in a diode form, and a threshold voltage compensation of the first transistor T1 may be performed. The second period P2 may be a period for compensating for the threshold voltage of the first transistor T1 and may be understood as a threshold voltage compensation period. The second period P2 that is the threshold voltage compensation period may be determined by a length of a period in which the second scan signal is supplied. For example, the second period P2 may be set to three horizontal periods or longer, and in this case, a sufficient threshold voltage compensation time may be secured. However, this is an example, and a length of the second period P2 is not limited thereto, and design may be freely modified according to a driving condition or the like.

Since the first power voltage VDD is maintained at the fourth node N4 during the second period P2, coupling effect of the first capacitor C1 may be substantially eliminated. That is, since the voltage of the fourth node N4 is not changed substantially, the voltage of the third node N3 may be changed to a difference between the first power voltage VDD and a threshold voltage Vth of the first transistor T1 (for example, VDD-Vth). Therefore, the threshold voltage Vth of the first transistor T1 may be stored in the first capacitor C1.

Thereafter, when supply of the second scan signal is stopped (for example, the second scan signal transits to the high level H) and the first emission control signal is supplied (for example, the first emission control signal transits to a high level H), the compensation period CP may be ended.

As described above, during the compensation period CP (or the first period P1 and the second period P2), the voltage of the gate electrode of the first transistor T1 may be initialized and the threshold voltage of the first transistor T1 may be compensated.

In FIG. 5A, each of the first scan signal and the second scan signal is supplied once during the compensation period CP, but an embodiment is not limited thereto.

For example, referring to FIG. 5C, each of the first scan signal and the second scan signal may be supplied a plurality of times (for example, twice as shown in FIG. 5C) during the compensation period CP. That is, in a plurality of first periods P1 and P1', a first scan signal of a low level L (or a gate-on level) may be supplied through the first scan line S1*i*, and in a plurality of second periods P2 and P2', a second scan signal of a low level L (or a gate-on level) may be supplied through the second scan line S2*i*.

As described above, since the first scan signal and the second scan signal are alternately supplied a plurality of times during the compensation period CP, a compensation time may be sufficiently secured, and reliability in threshold voltage compensation may be greatly improved.

In FIG. 5C, the first periods P1 and P1' and the second periods P2 and P2' are alternately repeated twice, but this is an example, and the first periods and the second periods may be repeated three or more times with each other.

Referring to FIG. 5A again, thereafter, the fourth scan signal may be supplied to the fourth scan line S4*i* in the third period P3. For example, a fourth scan signal of a low level L (or a gate-on level) may be supplied to the fourth scan line S4*i* in the third period P3. Accordingly, the second transistor T2 may be turned on. In addition, in the third period P3, the fifth transistor T5 may maintain a turn-on state based on a fifth scan signal of a high level H. A voltage of a data signal of a current frame (hereinafter, referred to as a current data voltage Vdata) may be supplied to the fourth node N4 through the second transistor T2 and the fifth transistor T5.

The voltage of the fourth node N4 may be changed from the first power voltage VDD to the current data voltage Vdata, and the voltage of the third node N3 may have a value reflecting coupling of the first capacitor C1 in the existing difference between the first power voltage VDD and the threshold voltage Vth of the first transistor T1 (for example, a value of "VDD−Vth+(Vdata−VDD)") by the coupling of the first capacitor C1. That is, the voltage of the third node N3 remains only a value of Vdata−Vth, and thereafter, the driving current may have a value corresponding to the current data voltage Vdata.

Supply of the fifth scan signal may be stopped (for example, the fifth scan signal supplied to the fifth scan line S5*i* transits to a low level L) after the third period P3 and before the fourth period P4, and the fifth transistor T5 may be turned off. Therefore, each of the voltage of the third node N3 and the voltage of the fourth node N4 may be maintained. However, this is an example, and the supply of the fifth scan signal may be stopped simultaneously with an end of the third period P3.

Thereafter, the third scan signal may be supplied to the third scan line S3*i* in the fourth period P4. For example, a third scan signal of a low level L (or a gate-on level) may be supplied to the third scan line S3*i* in the fourth period P4. Accordingly, the eighth transistor T8 and the ninth transistor T9 may be turned on.

The fourth power voltage Vint2 may be supplied to the fifth node N5 (or the first electrode of the light emitting element LD) by the turn-on of the eighth transistor T8. When the fourth power voltage Vint2 is supplied to the first electrode of the light emitting element LD, a residual voltage charged in the parasitic capacitor of the light emitting element LD may be discharged (or removed), and thus unintentional fine light emission may be prevented. The fourth period P4 may be a period for initializing the light emitting element LD and may be understood as a second initialization period.

In addition, the fifth power voltage Vbias may be supplied to the first node N1 (or the first electrode of the first transistor T1) by the turn-on of the ninth transistor T9. When the fifth power voltage Vbias is supplied to the first electrode (or the source electrode) of the first transistor T1, the first transistor T1 may be controlled to be in the on-bias state before light emission. The fourth period P4 may be a period for controlling the first transistor T1 to be in the on-bias state and may be understood as a first bias period. That is, the first bias period and the second initialization period may be the same (or overlapping) period.

In FIG. 5A, the third scan signal is supplied once, but an embodiment is not limited thereto.

For example, referring to FIG. 5C, the third scan signal may be supplied a plurality of times (for example, twice as shown in FIG. 5C). That is, in a plurality of fourth periods P4 and P4', a third scan signal of a low level L (or a gate-on level) may be supplied through the third scan line S3*i*.

As described above, as the third scan signal is supplied a plurality of times, the second initialization period for initialization of the light emitting element LD based on the fourth power voltage Vint2 and the first bias period for the on-bias of the first transistor T1 based on the fifth power voltage Vbias may be sufficiently secured.

Thereafter, supply of the first and second emission control signals may be stopped (for example, the first and second emission control signals transit to a low level L), and thus the first non-emission period NEP1 may be ended and the first emission period EP1 may proceed. In the first emission period EP1, the sixth and seventh transistors T6 and T7 may be turned on.

In the first emission period EP1, a driving current corresponding to the current data voltage Vdata written in the fourth period P4 may be supplied to the light emitting element LD, and the light emitting element LD may emit light based on the driving current.

As shown in FIG. 6A, the second driving period DP2 may include a second non-emission period NEP2 and a second emission period EP2, and the second non-emission period NEP2 may include a fifth period P5.

In an embodiment, waveforms of the first and second emission control signals in the second driving period DP2 may be substantially the same as waveforms of the first and second emission control signals in the first driving period DP1.

In an embodiment, the first, second, fourth, and fifth scan signals may not be supplied in the second driving period DP2. For example, in the second driving period DP2, first, second, and fourth scan signals of a high level H (or a gate-off level) may be supplied to the first, second, and fourth scan lines S1*i*, S2*i*, and S4*i*, respectively, and a fifth scan signal of a low level L (or a gate-off level) may be supplied to the fifth scan line S5*i*. Accordingly, the second to fifth transistors T2 to T5 may maintain a turn-off state.

The fifth scan signal may be supplied to the third scan line S3*i* in the fifth period P5 of the second non-emission period NEP2. For example, a third scan signal of a low level L (or a gate-on level) may be supplied to the third scan line S3*i* in the fifth period P5. Accordingly, the eighth and ninth transistors T8 and T9 may be turned on. Here, an operation of the pixel PX in the fifth period P5 may be substantially the same as or similar to an operation of the pixel PX in the fourth period P4 described with reference to FIG. 5A.

That is, the fifth period P5 may be understood as a third initialization period in which the light emitting element LD is initialized by the turn-on of the eighth transistor T8. In addition, the fifth period P5 may be understood as a second bias period in which the first transistor T1 is controlled to be in the on-bias state by the turn-on of the ninth transistor T9.

In FIG. 6A, the third scan signal is supplied once, but an embodiment is not limited thereto.

For example, referring to FIG. 6B, the third scan signal may be supplied a plurality of times (for example, twice as shown in FIG. 6B). That is, in a plurality of fifth periods P5 and P5', a third scan signal of a low level L (or a gate-on level) may be supplied through the third scan line S3*i*.

As described above, as the third scan signal is supplied a plurality of times, the third initialization period for initialization of the light emitting element LD based on the fourth power voltage Vint2 and the second bias period for the on-bias of the first transistor T1 based on the fifth power voltage Vbias may be sufficiently secured.

As described with reference to FIGS. 1, 4, and 5A to 6C, the pixel PX and the display device 1000 including the pixel PX according to embodiments described herein may secure the threshold voltage compensation time while removing an influence of a previous data voltage through the circuit structure as shown in FIG. 4 and control of the signals supplied to the pixel PX, and may prevent (remove) display quality deterioration according to a hysteresis characteristic change of the driving transistor by periodically applying the bias voltage (for example, the fifth power voltage Vbias) to the driving transistor (for example, the first transistor T1). In addition, since the pixel PX is driven using the first and second driving periods DP1 and DP2, image quality for various frame frequencies may be improved.

Figure 7A:
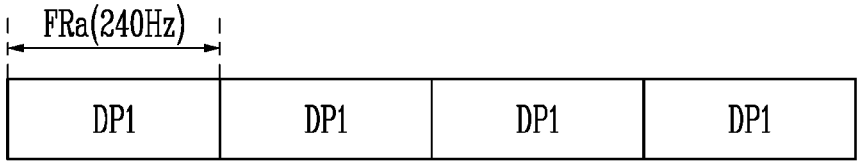
FIGS. 7A to 7C are diagrams illustrating an example of driving of the display device of FIG. 1 according to a frame frequency.
Figure 7B:
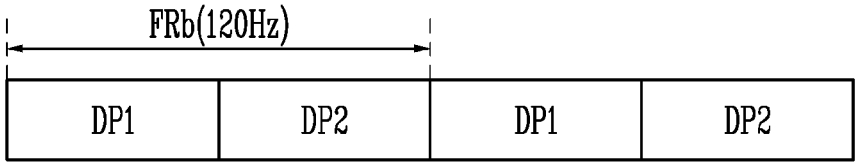
Figure 7C:
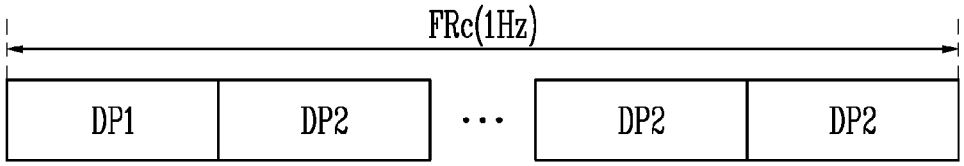

FIGS. 7A to 7C are diagrams illustrating an example of driving of the display device of FIG. 1 according to the frame frequency.

Referring to FIGS. 1 and 5A to 7C, the display device 1000 may be driven at various frame frequencies.

A frequency of the first driving period DP1 may correspond to the frame frequency.

In an embodiment, as shown in FIG. 7A, a first frame FRa may include the first driving period DP1. For example, when the frequency of the first driving period DP1 is 240 Hz, the first frame FRa may be driven at 240 Hz. For example, a length of the first driving period DP1 and the first frame FRa may be about 4.17 ms.

In an embodiment, as shown in FIG. 7B, a second frame FRb may include the first driving period DP1 and one second driving period DP2. For example, the first driving period DP1 and the second driving period DP2 may be repeated. In this case, the second frame FRb may be driven at 120 Hz. For example, a length of the first driving period DP1 and one second driving period DP2 may be about 4.17 ms, and a length of the second frame FRb may be about 8.33 ms.

In an embodiment, as shown in FIG. 7C, a third frame FRc may include one first driving period DP1 and a plurality of repeated second driving periods DP2. For example, when the third frame FRc is driven at 1 Hz, a length of the third frame FRc is about 1 second, and the second driving period DP2 may be repeated about 239 times within the third frame FRc.

As described above, by controlling the number of repetitions of the second driving period DP2 within one frame, the display device 1000 may be freely driven at various frame frequencies (for example, 1 Hz to 480 Hz).

Figure 8:
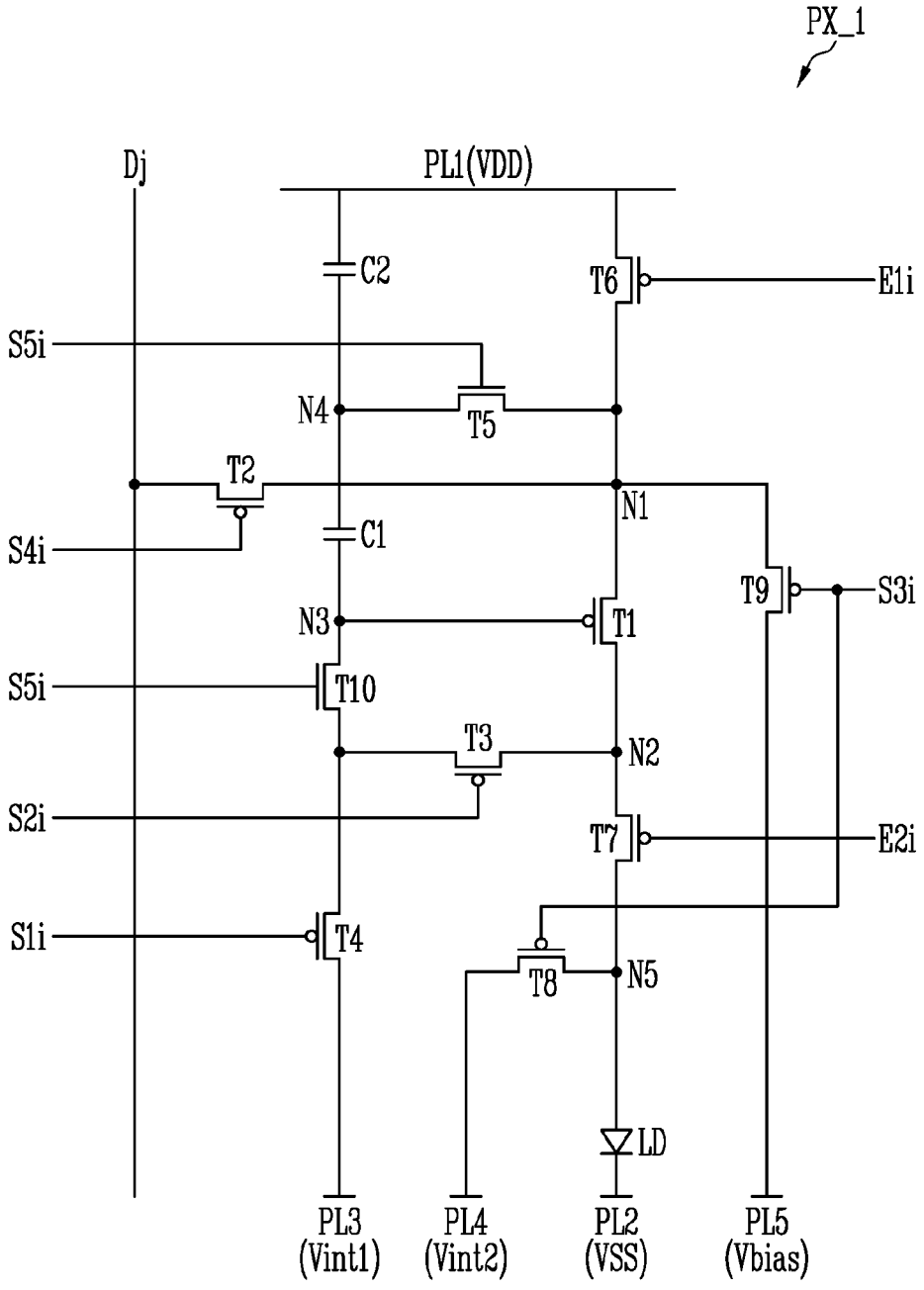
FIG. 8 is a circuit diagram illustrating an example of the pixel included in the display device of FIG. 1.

FIG. 8 is a circuit diagram illustrating an example of the pixel included in the display device of FIG. 1.

Since the pixel PX_1 of FIG. 8 is substantially the same as the pixel PX described with reference to FIG. 4 except that the pixel PX_1 further includes a tenth transistor T10, the same reference numerals are used for the same or corresponding components and repetitive description is omitted for ease in explanation of FIG. 8.

Referring to FIG. 8, the pixel PX_1 may include the light emitting element LD, the first to tenth transistors T1 to T10, the first capacitor C1 (or the storage capacitor), and the second capacitor C2 (or a holding capacitor).

The tenth transistor T10 may be connected between the third node N3 (or the gate electrode of the first transistor T1) and the fourth transistor T4 (or the third transistor T3). A gate electrode of the tenth transistor T10 may be connected to the fifth scan line S5*i*.

The tenth transistor T10 may be turned on when the fifth scan signal is supplied to the fifth scan line S5*i* to connect the first transistor T1 in a diode form together with the turned-on third transistor T3 or supply the third power voltage Vint1 from the third power line PL3 to the third node N3 (or the gate electrode of the first transistor T1) together with the turned-on fourth transistor T4.

For example, further referring to FIG. 5A, since the fifth scan signal supplied to the fifth scan line S5*i* in the compensation period CP is maintained as a high level H (or a gate-on level), the tenth transistor T10 may maintain a turn-on state.

In the first period P1 of the compensation period CP, as the first scan signal is supplied to the first scan line S1*i*, the fourth transistor T4 is turned on, and the third power voltage Vint1 may be supplied to the third node N3 through the transistor T4 and the tenth transistor T10. Therefore, the voltage of the third node N3 (that is, the voltage of the gate electrode of the first transistor T1) may be initialized to the third power voltage Vint1.

In addition, as the second scan signal is supplied to the second scan line S2*i* in the second period P2 of the compensation period CP, the third transistor T3 may be turned on, the first transistor T1 may be connected in a diode form by the turned-on third transistor T3 and the tenth transistor T10, and threshold voltage compensation of the first transistor T1 may be performed.

In an embodiment, the tenth transistor T10 may be an oxide semiconductor transistor. The tenth transistor T10 may include an oxide semiconductor layer as an active layer (a semiconductor layer, or a channel layer). For example, the tenth transistor T10 may be an n-type oxide semiconductor transistor.

Since the pixel PX_1 of FIG. 8 may include the tenth transistor T10 connected to the gate electrode (that is, the third node N3) of the first transistor T1 and configured of an oxide semiconductor transistor, a leakage current from the gate electrode of the first transistor T1 may be minimized, and thus display quality may be improved.

Figure 9:
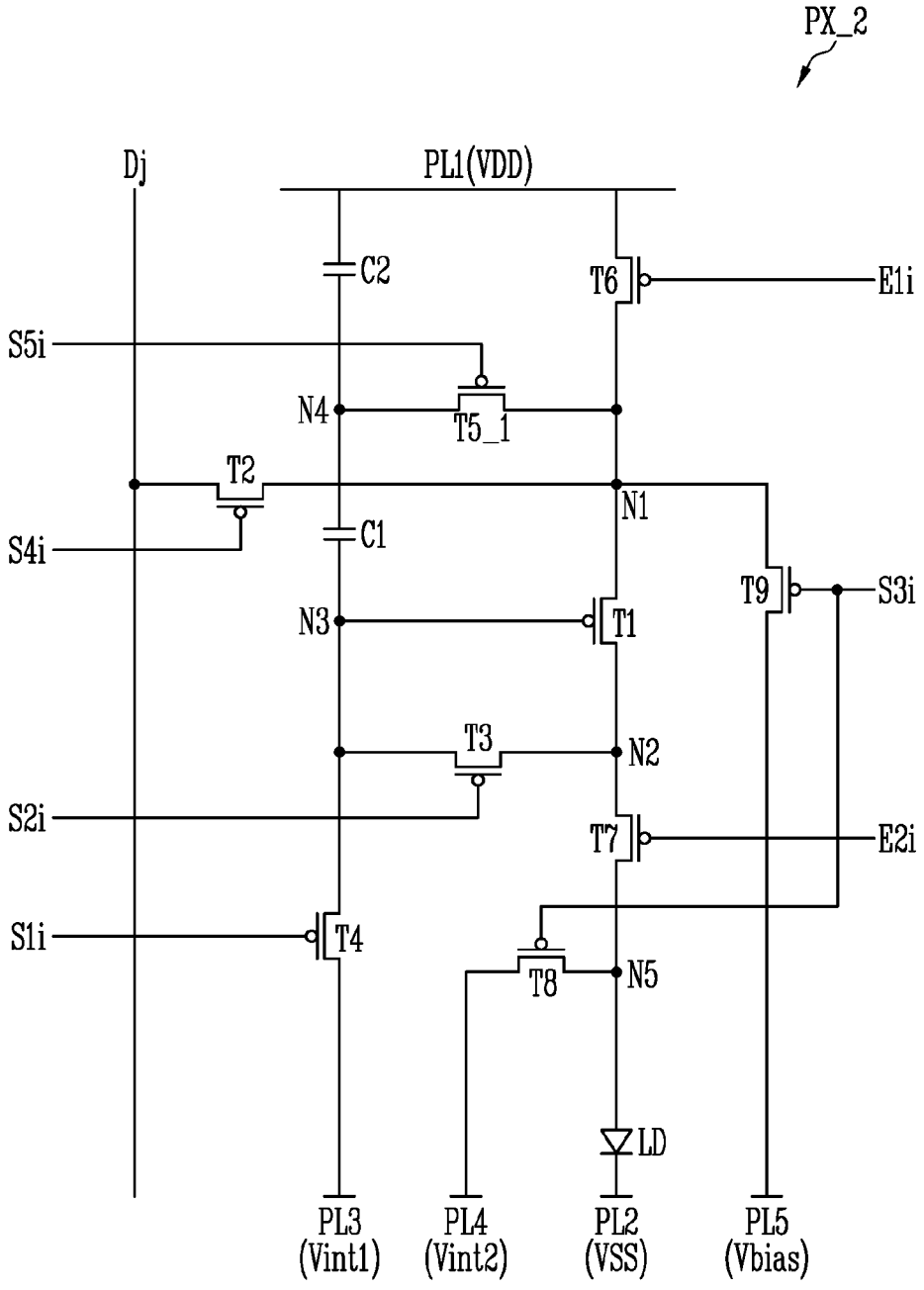
FIG. 9 is a circuit diagram illustrating an example of the pixel included in the display device of FIG. 1.
Figure 10:
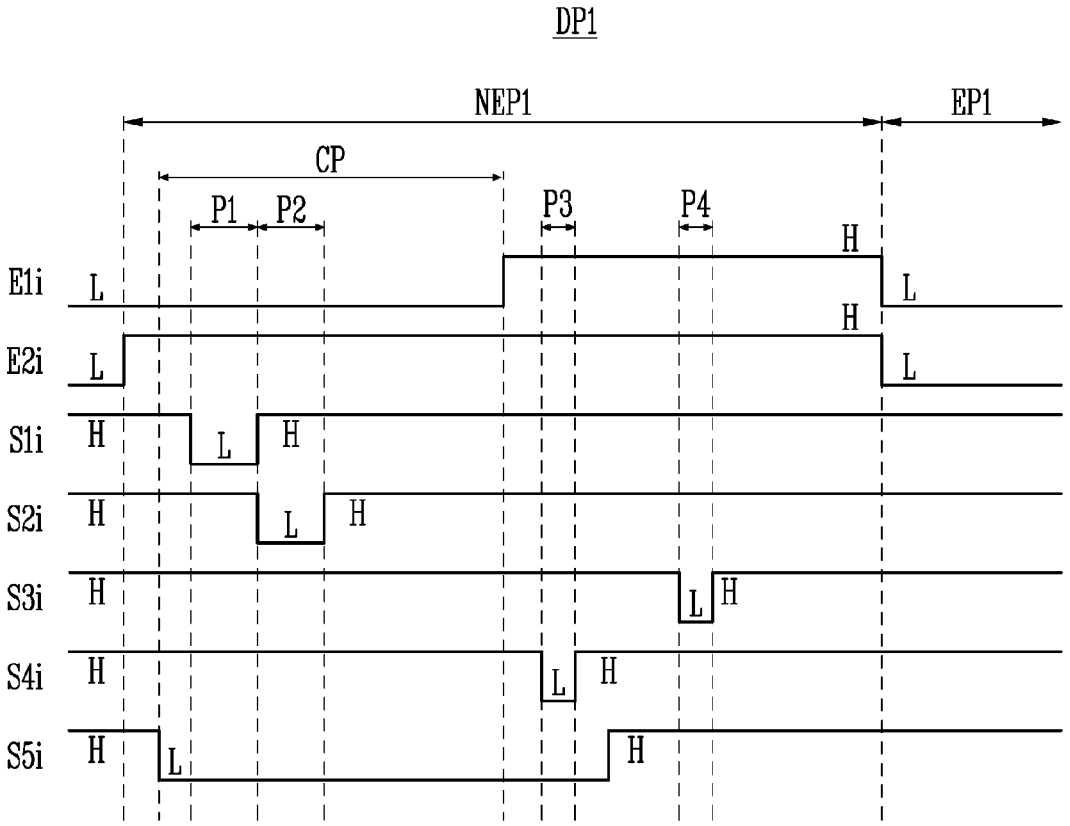
FIG. 10 is a timing diagram illustrating an example of signals supplied to the pixel of FIG. 9 in the first driving period.
Figure 11:
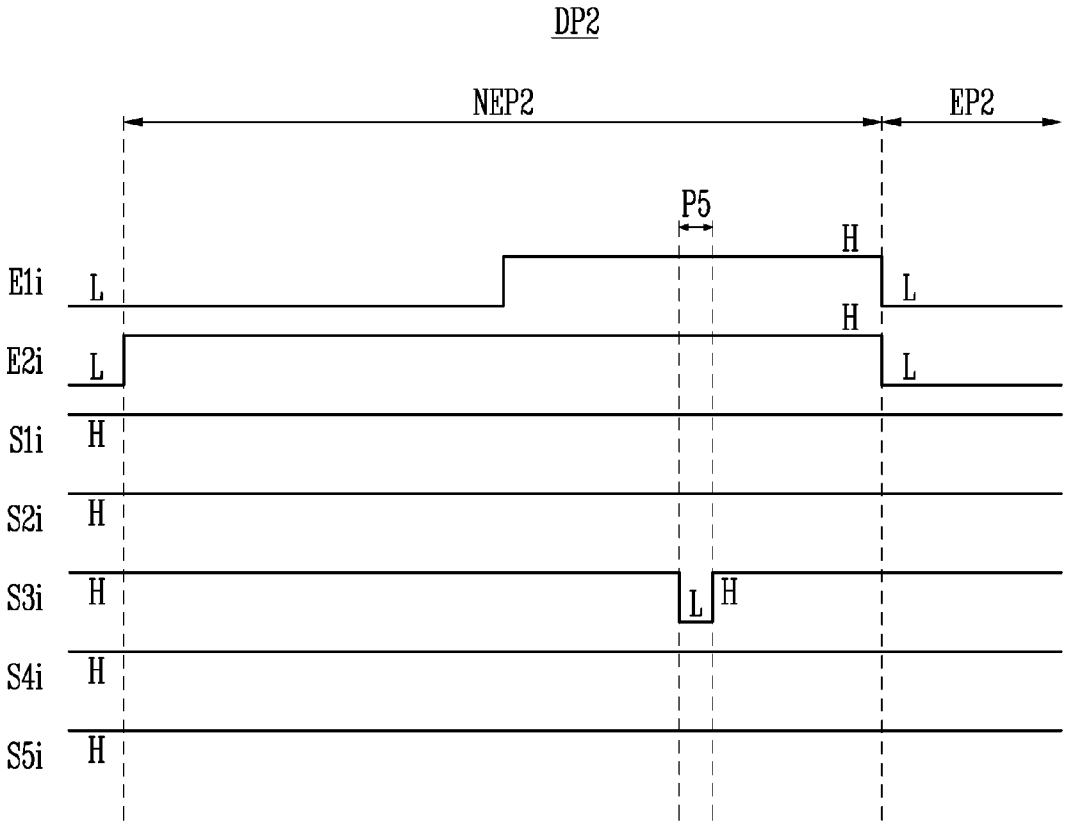
FIG. 11 is a timing diagram illustrating an example of signals supplied to the pixel of FIG. 9 in the second driving period.

FIG. 9 is a circuit diagram illustrating an example of the pixel included in the display device of FIG. 1, FIG. 10 is a timing diagram illustrating an example of signals supplied to the pixel of FIG. 9 in the first driving period, and FIG. 11 is a timing diagram illustrating an example of signals supplied to the pixel of FIG. 9 in the second driving period.

Since the pixel PX_2 of FIG. 9 has the same configuration and operation as the pixel PX described with reference to FIG. 4 except for a fifth transistor T5_1, the same reference numerals are used for the same or corresponding components, and repetitive description is omitted for ease in explanation of FIG. 9.

Referring to FIG. 9, the pixel PX_2 may include the light emitting element LD, the first to ninth transistors T1 to T4, T5_1, and T6 to T9, the first capacitor C1 (or the storage capacitor), the second capacitor C2 (or the holding capacitor).

In an embodiment, the fifth transistor T5_1 may be implemented as a polysilicon semiconductor transistor. That is, the fifth transistor T5_1 may include a polysilicon semiconductor layer formed through a low temperature polysilicon (LTPS) process as an active layer (a semiconductor layer, or a channel layer). Since the polysilicon semiconductor transistor has an advantage of a fast response speed, a switching characteristic of the fifth transistor T5_1 may be improved.

Since the fifth transistor T5_1 is implemented as a polysilicon semiconductor transistor, the fifth scan signal supplied through the fifth scan line S5*i* connected to a gate electrode of the fifth transistor T5_1 may have a signal level corresponding to the fifth transistor T5_1.

For example, referring further to FIG. 10, the fifth scan signal supplied to the fifth transistor T5_1 may have a low level L. That is, in the compensation period CP of the first non-emission period NEP1, the fifth scan signal may maintain the low level L (or the gate-on level).

As another example, further referring to FIG. 11, since the fifth scan signal is not supplied in the second driving period DP2, the fifth scan signal supplied to the fifth transistor T5_1 in the second driving period DP2 may maintain a high level H (or a gate-off level).

The pixel and the display device including the same according to embodiments described herein include the n-type oxide semiconductor transistor, and thus image quality deterioration due to current leakage in the pixel during low-frequency driving may be prevented.

In addition, the pixel and the display device including the same according to embodiments described herein may secure a threshold voltage compensation time while removing an influence of a voltage of a data signal of a previous frame through control of the emission control signal and the scan signal. In addition, by periodically applying a bias voltage to a driving transistor, display quality deterioration due to a hysteresis characteristic change of the driving transistor may be prevented (or removed).

Furthermore, since the pixel is driven using first and second driving periods, image quality for various frame frequencies may be improved.

Although certain embodiments and implementations have been described herein, other embodiments and modifications will be apparent from this description. Accordingly, the inventive concepts are not limited to such embodiments, but rather to the broader scope of the appended claims and various obvious modifications and equivalent arrangements as would be apparent to a person of ordinary skill in the art.

What is claimed is:

1. A pixel comprising:

a light emitting element;

a first transistor connected between a first node and a second node and that generates a driving current flowing from a first power line that provides a first power voltage to a second power line that provides a second power voltage through the light emitting element;

a second transistor connected between a data line and the first node and turned on in response to a fourth scan signal supplied to a fourth scan line;

a third transistor connected between the second node and a third node that corresponds to a gate electrode of the first transistor and turned on in response to a second scan signal supplied to a second scan line;

a fourth transistor connected between the third node and a third power line that provides a third power voltage and turned on in response to a first scan signal supplied to a first scan line;

a fifth transistor connected between the first node and a fourth node and turned on in response to a fifth scan signal supplied to a fifth scan line;

a sixth transistor connected between the first power line and the first node and turned off in response to a first emission control signal supplied to a first emission control line;

a seventh transistor connected between the second node and a fifth node that corresponds to a first electrode of the light emitting element and turned off in response to a second emission control signal supplied to a second emission control line;

a first capacitor connected between the third node and the fourth node; and a second capacitor connected between the first power line and the fourth node.

2. The pixel according to claim 1, further comprising:

an eighth transistor connected between the fifth node and a fourth power line that provides a fourth power voltage and turned on in response to a third scan signal supplied to a third scan line; and a ninth transistor connected between the first node and a fifth power line that provides a fifth power voltage and turned on in response to the third scan signal.

3. The pixel according to claim 2, wherein the third scan signal is a signal from which the first scan signal is shifted.

4. The pixel according to claim 1, wherein the fifth transistor is an n-type oxide semiconductor transistor.

5. The pixel according to claim 1, wherein the fifth transistor is a p-type polysilicon semiconductor transistor.

6. The pixel according to claim 1, further comprising:

a tenth transistor connected between the third node and the fourth transistor and turned on in response to the fifth scan signal.

7. The pixel according to claim 6, wherein the fifth transistor and the tenth transistor are n-type oxide semiconductor transistors.

8. The pixel according to claim 1, wherein a period in which the third transistor is turned on overlaps at least a portion of a period in which the fifth transistor is turned on.

9. The pixel according to claim 1, wherein a period in which the fourth transistor is turned on overlaps at least a portion of a period in which the fifth transistor is turned on.

10. The pixel according to claim 1, wherein the second scan signal is a signal from which the first scan signal is shifted.

11. A display device comprising:

a pixel connected to first to fifth scan lines, first and second emission control lines, and a data line;

a scan driver configured to supply first to fifth scan signals to the first to fifth scan lines, respectively;

an emission driver configured to supply first and second emission control signals to the first and second emission control lines, respectively; and a data driver configured to supply a data signal to the data line, wherein the pixel comprises:

a light emitting element;

a first transistor connected between a first node and a second node and that generates a driving current flowing from a first power line that provides a first power voltage to a second power line that provides a second power voltage through the light emitting element;

a second transistor connected between the data line and the first node and turned on in response to the fourth scan signal;

a third transistor connected between the second node and a third node that corresponds to a gate electrode of the first transistor and turned on in response to the second scan signal;

a fourth transistor connected between the third node and a third power line that provides a third power voltage and turned on in response to the first scan signal;

a fifth transistor connected between the first node and a fourth node and turned on in response to the fifth scan signal;

a sixth transistor connected between the first power line and the first node and turned off in response to a first emission control signal;

a seventh transistor connected between the second node and a fifth node that corresponds to a first electrode of the light emitting element and turned off in response to the second emission control signal;

a first capacitor connected between the third node and the fourth node; and a second capacitor connected between the first power line and the fourth node.

12. The display device according to claim 11, wherein the pixel further comprises:

an eighth transistor connected between the fifth node and a fourth power line that provides a fourth power voltage and turned on in response to the third scan signal; and a ninth transistor connected between the first node and a fifth power line that provides a fifth power voltage and turned on in response to the third scan signal.

13. The display device according to claim 11, wherein the fifth transistor is an n-type oxide semiconductor transistor.

14. The display device according to claim 11, wherein the fifth transistor is a p-type polysilicon semiconductor transistor.

15. The display device according to claim 11, wherein the pixel further comprises a tenth transistor connected between the third node and the fourth transistor and turned on in response to the fifth scan signal.

16. The display device according to claim 15, wherein the fifth transistor and the tenth transistor are n-type oxide semiconductor transistors.

17. The display device according to claim 11, wherein a period in which the scan driver is configured to supply the first scan signal that overlaps at least a portion of a period in which the scan driver is configured to supply the fifth scan signal.

18. The display device according to claim 11, wherein a period in which the scan driver is configured to supply the second scan signal that overlaps at least a portion of a period in which the scan driver is configured to supply the fifth scan signal.

19. The display device according to claim 11, wherein the scan driver comprises:

a first scan driver configured to supply the first to third scan signals to the first to third scan lines, respectively;

a second scan driver configured to supply the fourth scan signal to the fourth scan line; and a third scan driver configured to supply the fifth scan signal to the fifth scan line.

20. The display device according to claim 19, wherein the second scan signal is a signal from which the first scan signal is shifted, and the third scan signal is a signal from which the first scan signal is shifted.

* * * * *